US005241355A

United States Patent [19]

Yamashita et al.

[11] Patent Number: 5,241,355

[45] Date of Patent: Aug. 31, 1993

[54] IMAGE FORMING APPARATUS FOR PROCESSING SHEETS OF IMAGE-BEARING COPY PAPER

[75] Inventors: Hiroki Yamashita, Okazaki; Yoshihito Hirano, Toyokawa, both of Japan

[73] Assignee: Minolta Camera Kabushiki Kaisha, Osaka, Japan

[21] Appl. No.: 957,440

[22] Filed: Oct. 7, 1992

[30] Foreign Application Priority Data

Oct. 15, 1991 [JP] Japan ..... 3-266560
Oct. 15, 1991 [JP] Japan ..... 3-266561
Oct. 15, 1991 [JP] Japan ..... 3-266562
Oct. 15, 1991 [JP] Japan ..... 3-266563

[51] Int. Cl.[5] ..... G03G 15/00; B42B 2/00
[52] U.S. Cl. ..... 355/324; 270/53
[58] Field of Search ..... 355/324; 270/37, 53; 412/11

[56] References Cited

U.S. PATENT DOCUMENTS 4,448,515 5/1984 Ishikawa ..... 355/14 R
4,523,750 6/1985 Hubler ..... 270/53
4,763,167 8/1988 Watanabe et al. ..... 355/324
4,864,350 9/1989 Ishiguro et al. ..... 355/311
5,073,803 12/1991 Kato et al. ..... 355/324
5,090,860 2/1992 Matsuo et al. ..... 412/11
5,114,130 5/1992 Hamanaka et al. ..... 270/53

FOREIGN PATENT DOCUMENTS 1-193757 7/1989 Japan .

*Primary Examiner*—R. L. Moses
*Attorney, Agent, or Firm*—Burns, Doane, Swecker & Mathis

[57] ABSTRACT

A copying apparatus having a stapling function and a punching function. When the allowable sheet capacity for stapling is X and the allowable sheet capacity for punching is Y and the both the staple and punch modes are selected, the number of processable sheets in the staple/punch mode is determined by setting the value X or Y, whichever is smaller, as the sheet capacity of the device. While processing is on-going in the staple/-punch mode, the staple/punch mode is cancelled when the number of copy sheets exceeds the capacity of the mode.

18 Claims, 27 Drawing Sheets

FIG. (e)

IMAGE FORMING APPARATUS FOR PROCESSING SHEETS OF IMAGE-BEARING COPY PAPER

BACKGROUND OF THE INVENTION

1. Field of the Invention

The present invention relates to an image forming apparatus, and more specifically relates to an image forming apparatus with a sheet processing unit for processing sheets discharged from the main unit of the image forming apparatus, said sheet processing including binding the discharged sheets with a stapler, punching holes in the discharged sheets and the like.

2. Description of the Related Art

Heretofore in the field of copying apparatus, various types of sheet processing units have been provided for accomplishing the processing, e.g., staple process, punch process, stamp process, paste process and the like, of copied sheets disposed in a processing tray in accordance with automated sheet handling in a diversity of ways.

For example, Japanese Patent Application No. 1-193757 discloses a copying apparatus which counts originals being fed onto a glass platen via an automatic document handler, and stops the progress of the copy process when the number of originals exceeds the processing capability of the staple process or punch process, and generates an alarm.

The maximum number of processable sheets M of the stapler in the stapling process and the maximum number of processable sheets N in the punching process generally are different. This dissimilarity in the maximum number of processable sheets is not considered in the previously mentioned apparatus, wherein the maximum number of processable sheets is set at thirty sheets.

SUMMARY OF THE INVENTION

A main object of the present invention is to provide a copying apparatus capable of flexibly setting the sheet processing capacity.

A further object of the invention is to provide a copying apparatus having a plurality of sheet processing functions, and which is capable of maximizing the capabilities of said functions.

A still further object of the invention is to provide a copying apparatus having a plurality of sheet processing modes, and which is capable of setting an allowable capacity without producing excessive load on the processing mechanism when at least two modes are selected simultaneously.

The aforesaid objects of the present invention are accomplished providing the copying apparatus of the present invention which provides maximum processing capacity for each processing function by setting optimum capacity based on the respective maximum processing capacities when a plurality of processing functions are selected.

BRIEF DESCRIPTION OF THE DRAWINGS

FIG. 1 briefly shows the construction of the copying apparatus;

FIGS. 2*a* through 2*e* are illustrations showing the operation of the recycle lever;

FIG. 3 is a top view of the operation panel provided on the copying apparatus;

FIG. 4 is a top view of the operation panel provided on the finisher unit;

FIG. 5 is a block diagram showing the control circuit;

FIG. 6 is a flow chart showing the main routine of the CPU for controlling the main unit of the copying apparatus;

FIG. 7 is a flow chart showing the mode setting subroutine executed in step S3;

FIG. 8 is a flow chart showing the first half of the copy number setting subroutine executed in step S4;

FIG. 9 is a flow chart showing the second half of the copy number setting subroutine executed in step S4;

FIG. 10 is a flow chart showing the first half of the capacity setting subroutine executed in step S5;

FIG. 11 is a flow chart showing the second half of the capacity setting subroutine executed in step S5;

FIG. 12 is a flow chart showing the subroutine for communication with other CPUs executed in step S6;

FIG. 13 is a flow chart showing the first half of the paper feeding subroutine executed in step S7;

FIG. 14 is a flow chart showing the second half of the paper feeding subroutine executed in step S7;

FIG. 15 is a flow chart showing the copy process subroutine executed in step S8;

FIG. 16 is a flow chart showing the main routine of the CPU for controlling the RDH;

FIG. 17 is a flow chart showing the document feed subroutine executed in step S13;

FIG. 18 is a flow chart showing the document count subroutine executed in step S14;

FIG. 19 is a flow chart showing the recycle lever setting subroutine executed in step S17;

FIG. 20 is a flow chart showing the main routine of the CPU for controlling the finisher unit;

FIG. 21 is a flow chart showing the finishing process subroutine executed in step S27;

FIG. 22 is a flow chart showing the sheet discharge subroutine executed in step S28;

FIG. 23 is a flow chart showing the first half of capacity setting subroutine executed in step S5' in the main routine of the CPU for controlling the main unit of the copying apparatus;

FIG. 24 is a flow chart showing the second half of the capacity setting subroutine executed in step S5';

FIG. 25 is a flow chart showing the main routine of the CPU for controlling the RDH;

FIG. 26 is a flow chart showing the document count subroutine executed in step S14';

FIG. 27 is a flow chart showing the second document feeding subroutine executed in step S19.

DESCRIPTION OF THE PREFERRED EMBODIMENTS

Figure 1:
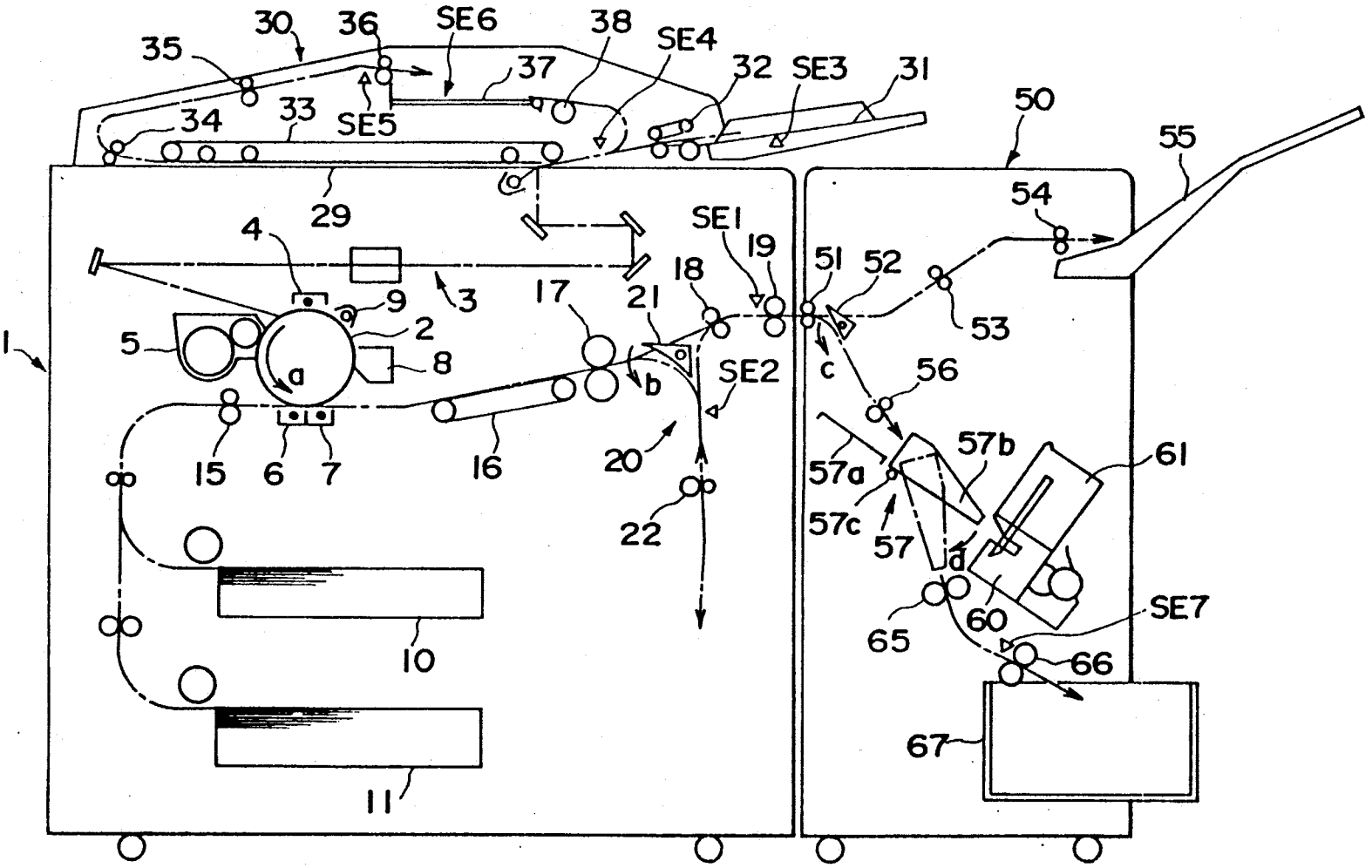
FIGS. 1 through 22 show a first embodiment of the present invention.
Figure 2:
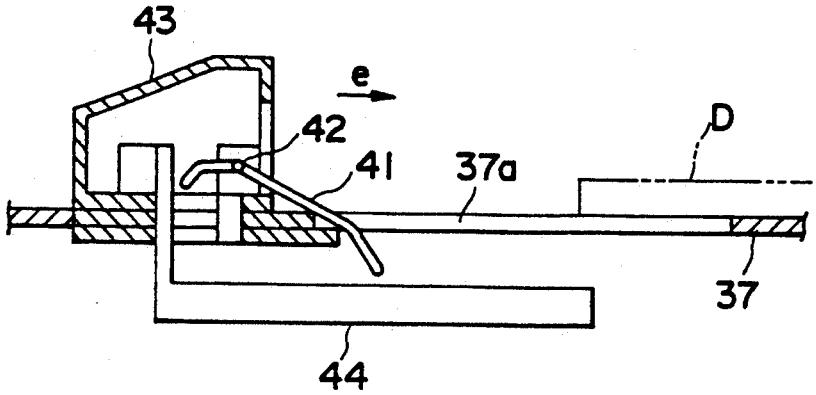
Figure 2:
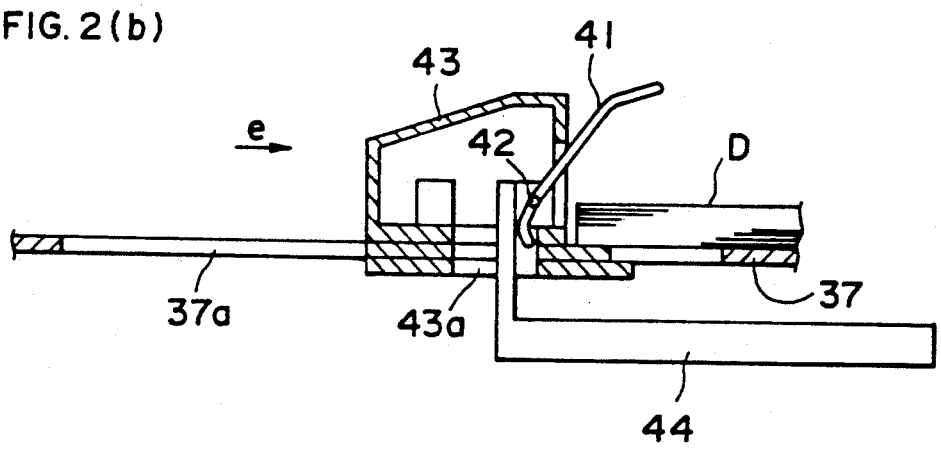
Figure 2:
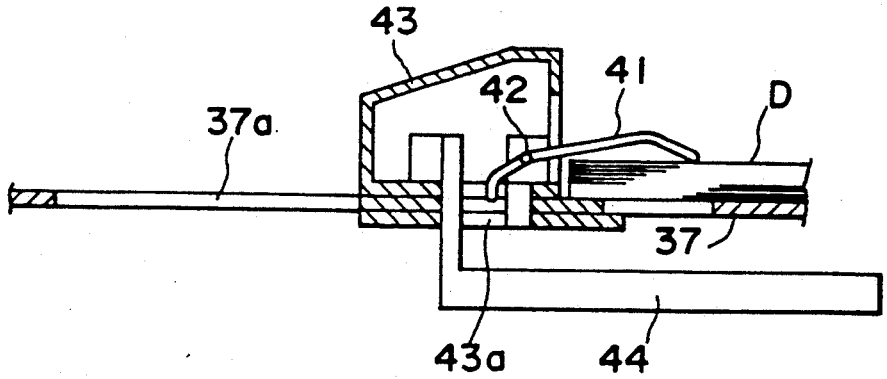
Figure 2D:
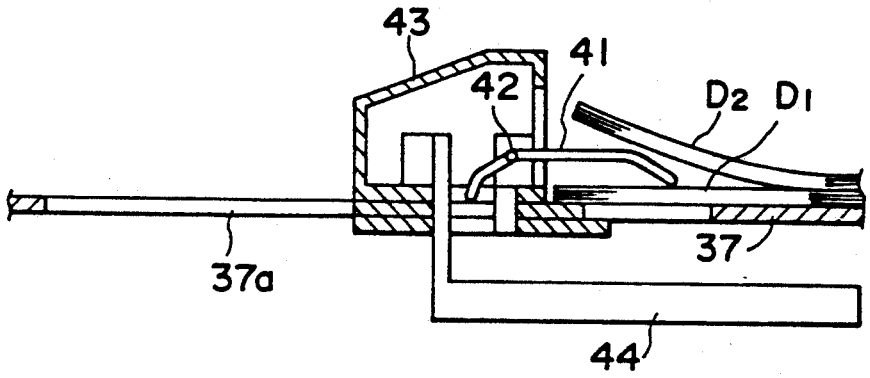
Figure 2D:
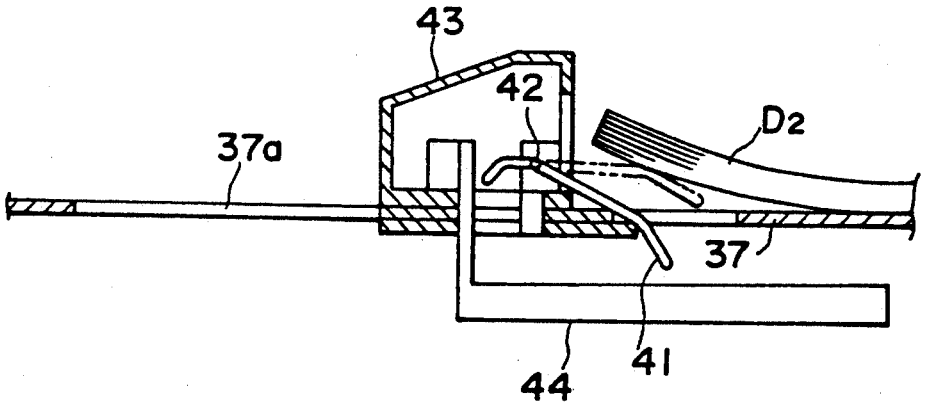
Figure 3:
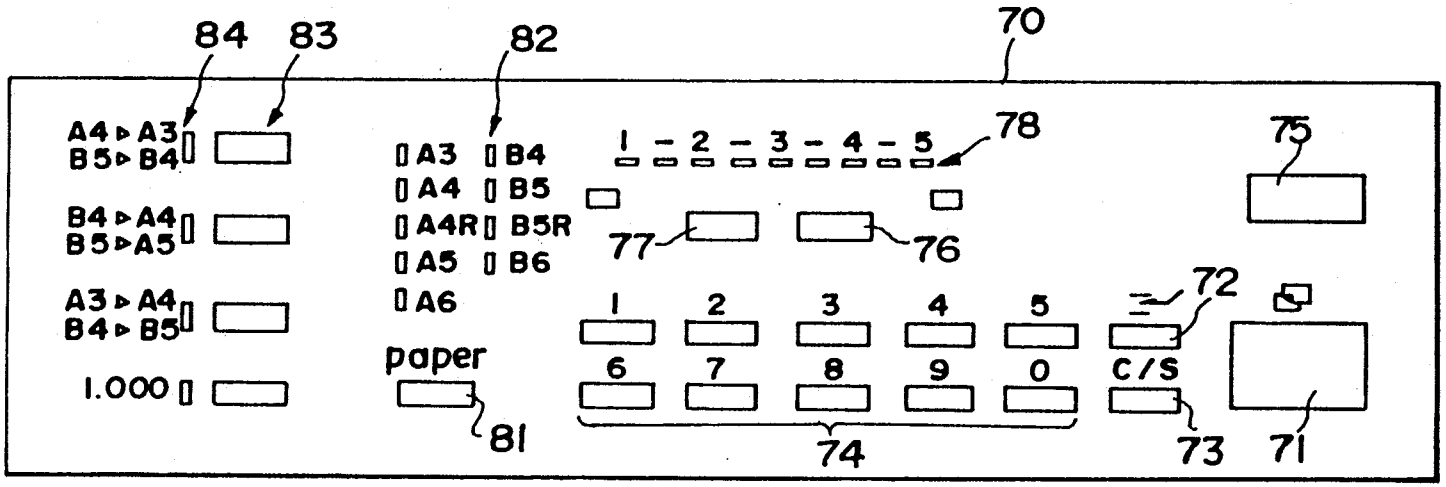
Figure 4:
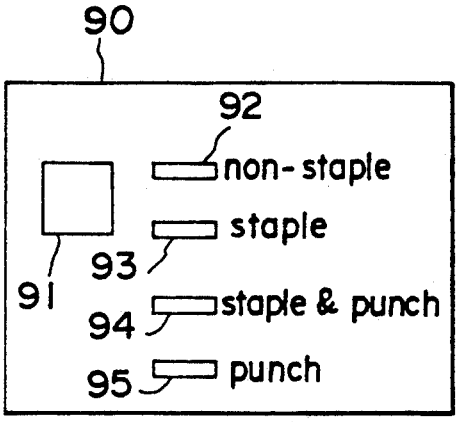

The embodiments described hereinafter apply the present invention to an electrophotographic copying apparatus. The main unit of the copying apparatus is provided with an optional automatic document handling device of the recycling type and a finisher unit capable of accomplishing a stapling process and punching process.

First Embodiment (refer to FIGS. 1~22)

The copying apparatus is described briefly hereinafter with reference to FIG. 1.

The main unit 1 of the copying apparatus is provided with a centrally disposed photosensitive drum 2 which is rotatably driven in the arrow a direction, and arranged around said photosensitive drum 2 is an optical unit 3, charger 4, developing device 5, transfer charger 6, sheet separation charger 7, residual toner cleaner 8, and residual charge eraser lamp 9. The aforesaid image forming elements and the copying process in which they are used are well known and, therefore, a description of them is omitted herefrom.

Copy paper is accommodated in cassettes 10 and 11. Sheets are selectively fed one sheet at a time from either said cassette 10 or 11, and transported via the timing roller 15 to the transfer portion so as to arrive synchronously with the toner image formed on the surface of the photosensitive drum 2. After the toner image is transferred, the sheet advances to the fixing unit 17 via the transport belt 16 and subjected to a toner fixing process, then is delivered to the finisher unit 50 via the transport roller 18 and the discharge roller 19. A sensor SE1 is provided immediately in front of the discharge roller 19 to detect the discharged sheet.

Furthermore, a sheet inverting mechanism 20 is provided within the aforesaid main unit 1 of the copying apparatus. The sheet inverting mechanism 20 comprises a feed direction switching member 21, inverting roller 22, sheet detecting sensor SE2, and sheet guides not shown in the drawing. The switching member 21 is set at a position which allows some rotation in the arrow b direction from the normal position indicated by the solid line in FIG. 1, so as to guide the top surface of the sheet toward the transport roller 18 (face-up discharged sheet). On the other hand, when the inverting mode is selected, the switching member 21 is set to the position indicated by the solid line in FIG. 1. At this time, the sheet is guided downward by the left side surface of the switching member 21, and fed downward via the forward rotation of the inverting roller 22. When the trailing end of the sheet is detected by the sensor SE2, the inverting roller 22 reverse rotates and feeds said sheet upward. The sheet is guided by the right side surface of the switching member 21 so as to be fed to the transport roller 18, and delivered to the finishing unit 50 from the discharge roller 19 (face-down discharged sheet).

The automatic document handling device 30 of the recycling type (hereinafter referred to as "RDH") comprises a document tray 31, feed roller 32, transport belt 33, transport rollers 34 and 35, discharge roller 36, recycling tray 37, and re-feed roller 38. Original documents are set on the document tray 31 so that one-sided originals are in the face-downward state, and fed sheet by sheet sequentially from the last page via feed roller 32, and are transported via the transport belt 33 so as to stop at a specified position on the document platen glass 29. When the original image scan by the optical unit 3 is completed, the original is fed leftward from the document platen glass 29 based on the rotation of the transport roller 33, and is fed past the transport rollers 34 and 35, so as to be stacked on the recycling tray 37 via the discharge roller 36. Thus, one group of original documents can be transferred from the document tray 31 to the recycling tray 37.

When the staple mode or the punch mode, described below, is selected as the finishing mode of the finisher unit 50, a first set of original documents is fed from the document tray 31 in the manner previously described during the first copying operation, and said first set of originals is stacked on the recycling tray 37 as the first cycle of image scans are completed. In the second and subsequent copying operations, the originals are fed one sheet at a time from the recycling tray 37 from the last page which is positioned as the lowermost page in the stack via the re-feed roller 38 so as to be fed onto the platen glass 29. That is, when the set number of copies (hereinafter referred to as "set copy number") is "5," the originals are recycled four times between the recycling tray 37 and the platen glass 29 during the second through the fifth copying operations.

In the RDH 30 of the aforesaid type, a sensor SE6 and recycle lever 41 are provided so as to differentiate between the originals subsequently fed to the recycling tray 37 thereafter and the scanned originals returned to the recycling tray 37, and thereby detect the fed sheet of the final original (first page of the original). The recycle lever 41 is rotatably mounted on the cover 43 so as to pivot on the pin 42, as shown in FIGS. 2*a*–2*e*. The cover 43 is mounted so as to be reciprocally moveable in a channel 37*a* formed on one side of the recycle tray 37, and is reciprocally moved by means of a drive lever 44 which projects upward from below.

When the originals are fed from the document tray 31, the cover 43 and the recycle lever 41 wait at the positions shown in FIG. 2*a*, such that the front end of the recycle lever 41 drops into the channel 37*a* of the recycle tray 37 due to its own weight. In this state, the scanned originals D are stacked in the recycling tray 37. When all the originals D are stacked in the recycling tray 37, the drive lever 44 is moved in the arrow e direction, the recycle lever 41 rotates upwardly in conjunction with the movement of the drive lever 44 in the arrow e direction, and the cover 43 is moved in the arrow e direction to a position adjacent to one side of the original D (refer to FIG. 2*b*). When the drive lever 44 is moved in the opposite direction to the arrow e direction within the channel 43*a* of the cover 43, the contact of the drive lever with the back end of the recycle lever 41 is released. Thus, the recycle lever 41 is rotated downwardly such that the front end of the lever 41 comes into contact with the originals D (refer to FIG. 2*c*).

The re-fed originals D are fed sequentially from the last page at the lowermost position in the aforesaid state. The scanned originals $D_2$ are stacked on the recycling tray 37 on top of the un-fed originals $D_1$ so as to sandwich the recycle lever 41 therebetween (refer to FIG. 2*d*). When the last original (the first page of the original) is fed, the recycle lever 41 drops into the channel 37*a* of the recycling tray 37 (refer to FIG. 2*e*). Thereafter, the drive lever 44 moves in the opposite direction to arrow e, and in conjunction with said movement, the cover 43 and the recycle lever 41 both move so as to return to the positional states shown in FIG. 2*a*. Then, the front end of the recycle lever 41 makes contact with the top of the originals D via the movement of the drive lever 44 to the positions shown in FIGS. 2*b* and 2*c*.

The recycle sensor SE6 shown in FIG. 1 outputs an OFF signal when the back end of the recycle lever 41 is in the state shown in FIGS. 2*a* and 2*e*. A single cycle of the originals D is detected by means of the aforesaid OFF signal.

In addition to the sensor SE6 which detects the presence of originals, the sensors SE3, SE4 and SE5 also are provided in the RDH 30. The sensor SE3 detects the presence of originals disposed on the document tray 31; sensor SE4 detects fed originals to count the number of said originals; and sensor SE5 detects originals discharged to the recycling tray 37.

The cycle of the image copying process during the time the point where all originals set on the document tray 31, or all originals set on the recycle tray 41, are circulated and returned to the recycle tray 37 is defined as a single cycle of the copying process.

The construction and operation of the finisher unit 50 is described hereinafter. The finisher unit 50 comprises receiving rollers 51, feed direction switching member 52, transport rollers 53, discharge roller 54, elevator/-shift tray 55, collecting rollers 56, adjustable tray 57, stapler 60, punch 61, output rollers 65, discharge rollers 66, and stacker 67.

In the non-staple mode, the switching member 52 is set in position somewhat rotated in the arrow c direction from the position indicated by the solid line in FIG. 1, so as to guide the sheets discharged from the copying apparatus main unit by means of the upper surface of said switching member 52. The sheets pass between the rollers 53 and discharge rollers 54 to be stacked on the elevator/shift tray 55. This tray 55 may be lowered incrementally in steps in accordance with the quantity of stacked sheets, and is reciprocally moveable in a horizontal direction such that said tray 55 moves horizontally a predetermined amount each time a single cycle of the copying process is completed so as to separate single groups of the copy sheets.

On the other hand, when the staple mode and/or the punch mode is selected, the switching member 52 is set at the position indicated by the solid line in FIG. 1. At this time, the sheets are guided downward by the left side surface of the switching member 52, so as to be fed from the collecting rollers 56 and be stacked on the adjustable tray 57.

The stapler 60 has a well known mechanism for automatically binding a bundle of copy sheets by means of pin-like staples. The punch 61 has a well known mechanism for punching holes in a bundle of copy sheets at predetermined positions by means of punch rods. The punch 61 has two-hole specifications and three-hole specifications, either of which may be incorporated in the finisher unit 50.

The adjustable tray 57 comprises a base plate **57*a* and an adjustable plate 57*b*, and said adjustable plate 57*b* is rotatable upon a shaft 57*c* between the solid line position and the dashed line position shown in FIG. 1. The adjustable plate 57*b* is normally set at the solid line position, and in this state, sheets are accommodated, adjusted, stapled and/or punch processed. After the required processes are completed, the adjustable plate 57*b* is rotated to the dashed line position, and the bundle of processed sheets begins to slide smoothly from the adjustable tray 57 via its own weight, through the discharge rollers 66, and is stacked in the stacker 67. A sensor SE7 is provided immediately in front of the discharge rollers 66** to detect the bundle of sheets as it is discharged.

The operation panels are described hereinafter. The operation panels include operation panel 70 provided on the main unit of the copying apparatus (refer to FIG. 3), and operation panel 90 provided on the finisher unit 50 (refer to FIG. 4).

The operation panel 70 is provided with display devices and keys built into the switches and described below.

Copy start key 71: starts the copying operation.

Interrupt key 72: temporarily interrupts a multicopy operation.

Clear/Stop key 73: stops a copy operation, and cancels the set copy number and operation mode.

Ten-key pad 74: sets the number of copies. Keys correspond to numerals 1~9 and 0.

Display 75: displays the set number of copies and the state of the copying apparatus.

Density increase key 76 and density decrease key 77: set the image density.

Display LED 78: displays the image density set via the aforesaid keys 76 and 77.

Paper selection key 81: selects the size of the copy paper to be used.

Display LED 82: displays the copy paper size selected via the aforesaid key 81.

Magnification selection key 83: selects the preset copy magnifications.

Display LED 84: displays the copy magnification selected via key 83.

On the other hand, the finisher operation panel 90 is provided with a finish mode selection key 91, non-staple mode display LED 92, staple mode display LED 93, staple/punch mode display LED 94, and punch mode LED 95. When the power source is turned ON, the LED 92 is lighted, and the non-staple mode is set at initialization. Thereafter, each time the mode selection key 91 is depressed the selected mode is switched in the sequence: staple mode, staple/punch mode, punch mode, and non-staple mode, and the corresponding LEDs 93, 94, 95 and 92 are likewise sequentially lighted. The staple/punch mode specifies the simultaneous selection of both the staple mode and the punch mode.

Figure 5:
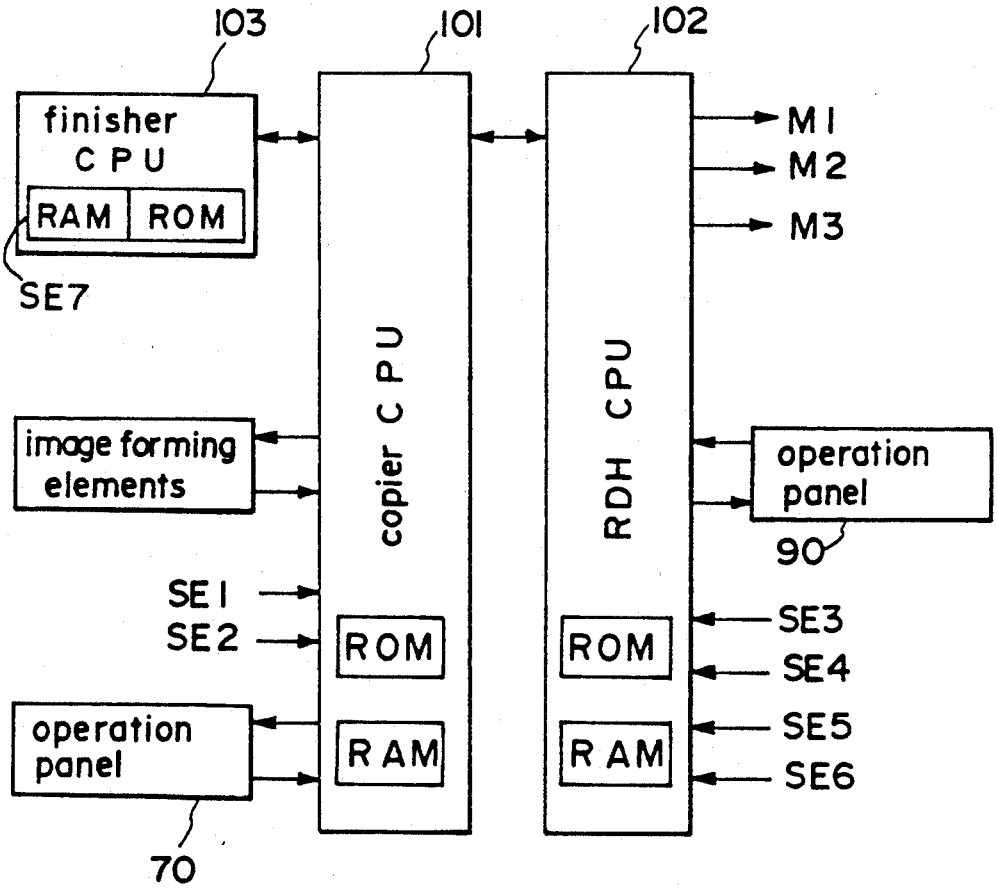

FIG. 5 shows the control circuit of the first embodiment of the copying apparatus.

The control circuit comprises a central processing unit (CPU) 101 for controlling the copying apparatus main unit 1, CPU 102 for controlling the RDH 30, CPU 103 for controlling the finisher unit 50, and a CPU (not illustrated) for controlling the optical unit 3. The CPU 101 is capable of transmitting the necessary signals to the other respective CPUs.

The various image forming elements such as the charger 4, transfer charger 6 and the like, as well as the various LEDs and keys on the operation panel 70 are connected to the input/output ports of the CPU 101; detection signals output by the sensors SE1 and SE2 are also transmitted to the input ports of the CPU 101. The CPU 102 is connected to the feed motor M1, transport motor M2, recycle lever drive motor M3, and the LEDs 92~95 and key 91 provided on the operation panel 90; detection signals output by the sensors SE3 through SE6 are also transmitted to the CPU 102. The CPU 103 is connected to the transport motor, stapler drive motor, punch drive motor, shift tray elevator motor, shift motor and the like; detection signals output by the sensor SE7 are transmitted to the CPU 103.

The control sequence of the copying apparatus provided via the aforesaid control circuit is described in detail hereinafter.

In the following description, the term "ON-edge" means the switching of the switches, sensors, signals and the like from the OFF state to the ON state, whereas the term "OFF-edge" means the switching of said switches, sensors, signals and the like from the ON state to the OFF state. Furthermore, the contact sensors SE1~SE5 and SE7 are turned ON when a sheet is detected, whereas the recycle sensor SE6, a contactless photosensor, is turned OFF when the optical path is shielded by the back end of the recycle lever 41.

Figure 6:
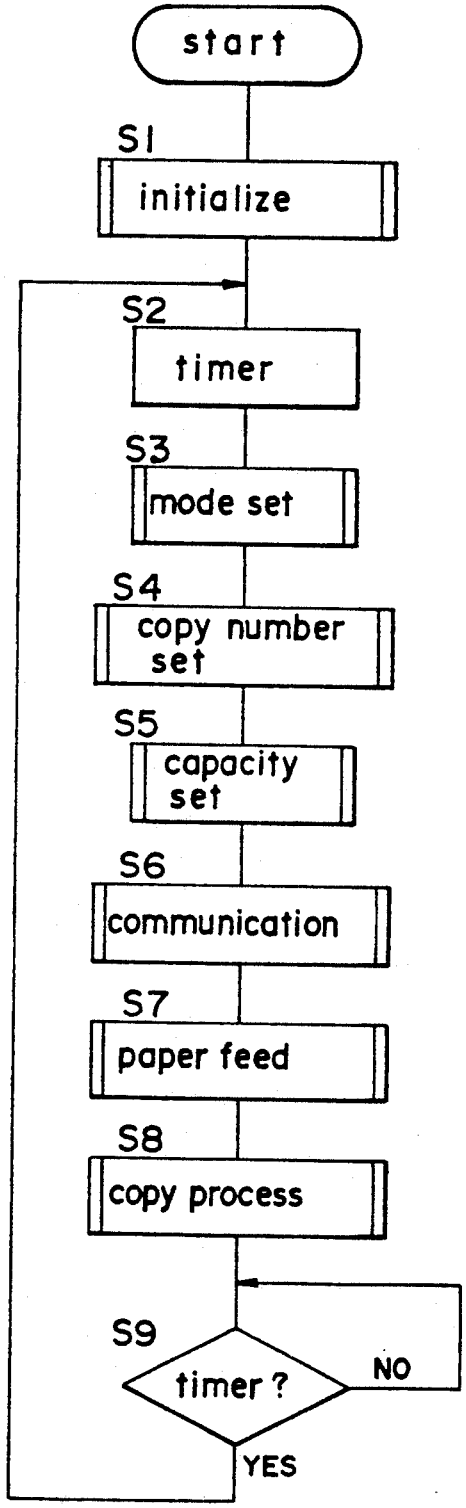

FIG. 6 shows the main routine of the CPU 101 for controlling the copying apparatus main unit 1.

When the power source is turned ON and the program of the CPU 101 starts, first, in step S1, initialization is executed to clear the random access memory (RAM), reset the various types of registers, and set the initial modes for the various types of components. In step S2, an internal timer is started. This internal timer determines the time required for one routine of the main routine, and the value set in said timer is set in step S1.

Then, the various subroutines of steps S3~S8 are sequentially called, and the end of the internal timer is awaited in step S9. After the end of the internal timer, the routine returns to step S2.

In step S3, the copy mode and finish mode are set. In step S4, the number of copies is set. In step S5, the copy sheet capacity is set in accordance with the selected finish mode. In step S6, communications are executed with the other CPUs. In step S7, a check is made to determine whether or not a sheet is to be fed, and if so, the sheet feeding operation is executed. In step S8, the copy process is executed in the main unit 1 of the copying apparatus.

The previously mentioned subroutines are described hereinafter with reference to FIGS. 7~15.

Figure 7:
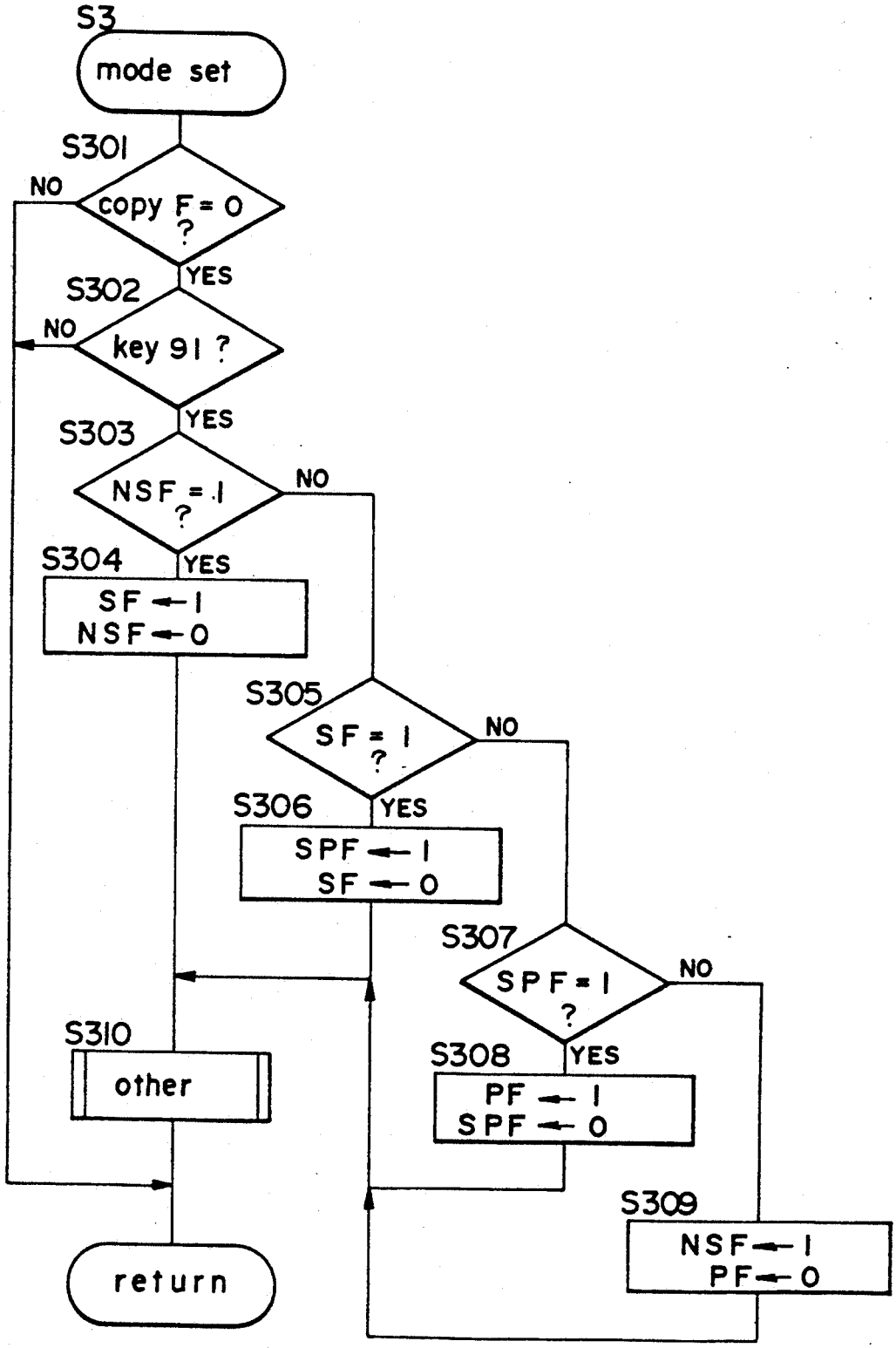

FIG. 7 shows the mode setting subroutine executed in step S3.

First, in step S301, a check is made to determine whether or not the copy flag is set at [0]. The copy flag is set at [1]when the copy start key 71 is turned ON (refer to step S704), and is reset at [0] when the finish process for the first set is completed, and when the finish process for the last copy cycle is completed (refer to steps S603 and S717). If the copy flag is set at [1], the subroutine ends immediately; when the copy flag is reset at [0], the following process is executed.

In step S302, a check is made to determine whether or not the finish mode selection key 91 is ON-edge. If the key 91 is ON-edge, further checks are made in steps S303, S305 and S307 to determine whether or not the non-staple flag NSF, staple flag SF, and staple/punch flag SPF are set at [1]. At initialization, the non-staple flag is set at [1] and the other flags are reset at [0]. Accordingly, when the mode selection key 91 is turned ON and the non-staple flag is set at [1], then in step S304, the staple flag is set at [1] and the non-staple flag is reset at [0]. If the staple flag is set at [1], then in step S306, the staple/punch flag is set at [1] and the staple flag is reset at [0]. If the staple/punch flag is set at [1], then in step S308, the punch flag is set at [1] and the staple/punch flag is reset at [0]. If the punch flag is set at [1], then in step S309, the non-staple flag is set at [1] and the punch flag is reset at [0].

Next, the copy sheet size selection and image density are set in step S310, and the subroutine returns to the main routine.

Figure 8:
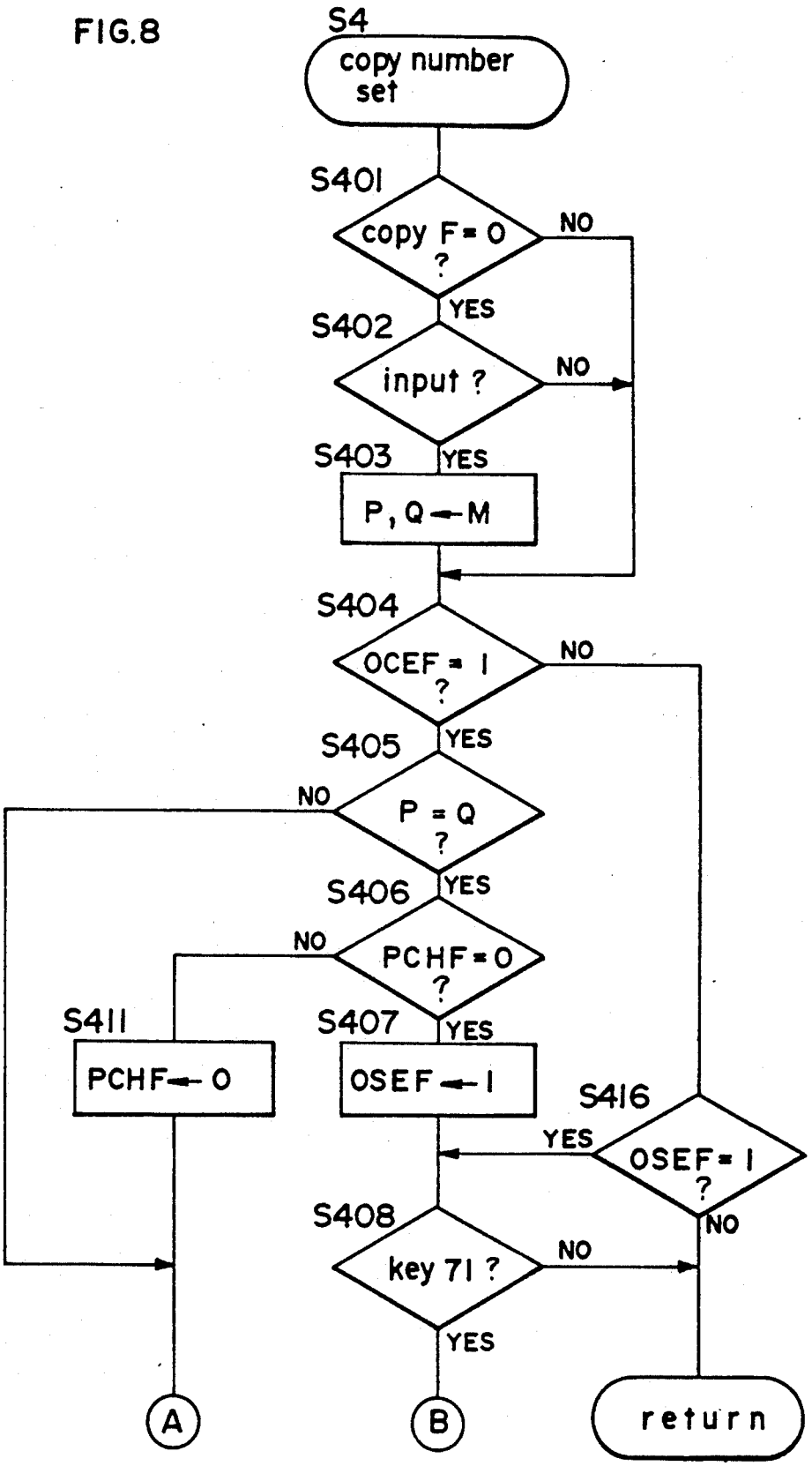
Figure 9:
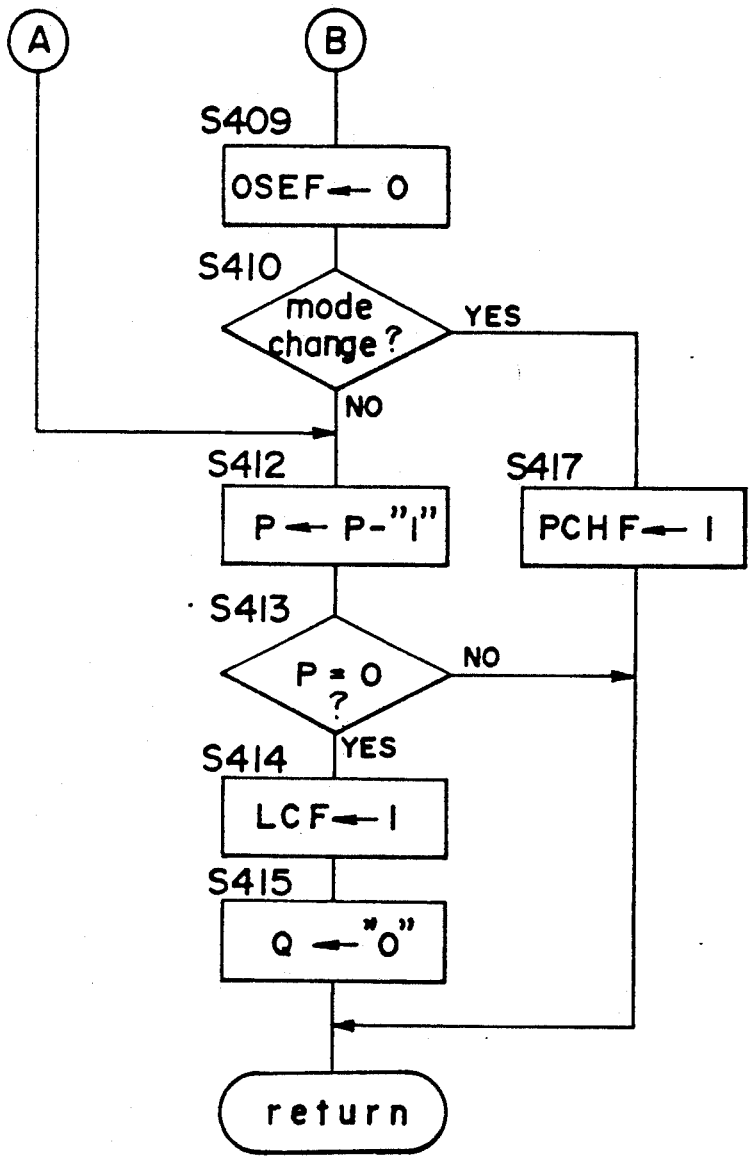

FIGS. 8 and 9 show the copy number setting subroutine executed in step S4.

First, a check is made in step S401 to determine whether or not the copy flag is set at [0]. If the copy flag has been reset at [0], i.e., if a copy process and finish process are not currently on-going, a check is made in step S402 to determine whether or not the number of copies M has been input via the ten-key pad 74. If the copy number M has been input, said set copy number M is stored in memory in the counters P and Q in step S403. The counter Q expresses the input set copy number M, whereas the counter P expresses the number of copies remaining.

Then, a check is made in step S404, to determine whether or not the one-cycle end flag OCEF is set at [1]. The one-cycle end flag OCEF is set at [1] when the last original (first page of the original) is fed from the tray 31 or tray 37 (refer to step S1706), and is reset at [0] when finish process is completed for the sheets of one-cycle (refer to step S604). If the flag OCEF is set at [1], a check is made in step S405 to determine whether or not the numerical values of the counters Q and P are equal. If the aforesaid numerical values are equal, the copy process is stopped once, because copy process has ended for the current copy set. At this time, an operator may determine the suitability of the copy image, or the suitability of the finish process. If the copy image is satisfactory and the selected finish mode is suitable, the copy process is restarted for the remaining copies (the remainder of the set number of copies) by turning ON the copy start key 71. If the copy image is unsatisfactory or the selected finish process is unsuitable, an operator may operate the density increase key 76, density decrease key 77 and the like, change the copy process mode, and turn On the copy start key 71. Thus, when the copy process mode is changed, the copy process is restarted to produce the initially set number of copies under the newly set copy process mode.

That is, in step S406, a check is made to determine whether or not the process change flag PCHF is set at [0]. The copy process change flag PCHF is set at [1] when the copy start key 71 is turned ON after the copy process and the finish process of the first copy set are completed and a copy process mode change is verified (refer to step S417). Therefore, if the process change flag has been reset at [0], then the one set end flag OSEF is set at [1] in step S407, and a check is made to determine whether or not the copy start key 71 is ON-edge in step S408. If the copy start key 71 is not ON-edge, this subroutine ends, whereas if the copy start key 71 is ON-edge, the one set end flag OSEF is reset at [0] in step S409, and a check is made in step S410 to determine whether or not the process mode has been changed. If the process mode has not been changed, the counter P is decremented by only "1" and the remainder of the set copy number is displayed because the operator has determined that the copy process and finish process for one set is satisfactory. Then, a check is made in step S413 to determine whether or not the numerical value of the counter P is zero ("0"). If the counter P value is zero ("0"), the last cycle flag LCF is set at [1] in step S414, and the counter Q is reset at zero ("0") in step S415.

On the other hand, when a change in the copy process mode is determined in step S410, the process change flag PCHF is set at [1] in step S417 and the subroutine returns to the main routine without decrementing the counter P. Accordingly, a one-set copy cycle is started with the set copy number as originally set, the reply to the query of step S406 is NO at the end of the copy cycle, and after the process change flag PCHF is reset at [0] in step S411, the counter P is decremented in step S412. Thus, when the copy mode is changed, e.g., when the copy density is increased due to the unsatisfactory copy density of the first set, the copy process is executed again for the number of copies corresponding to the original set copy number. In this case, the copy process is not stopped even when the process of one set ends.

The one-cycle end flag OCEF is reset at [0] when the finish process is completed for one set of sheets (refer to step S604). But in this case, the reply to the query of step S404 is NO, and since the one-cycle end flag OCEF has already been set at [1], when said flag OCEF is checked in step S416, the turning ON of the copy start key 71 is awaited in step S408.

Figure 10:
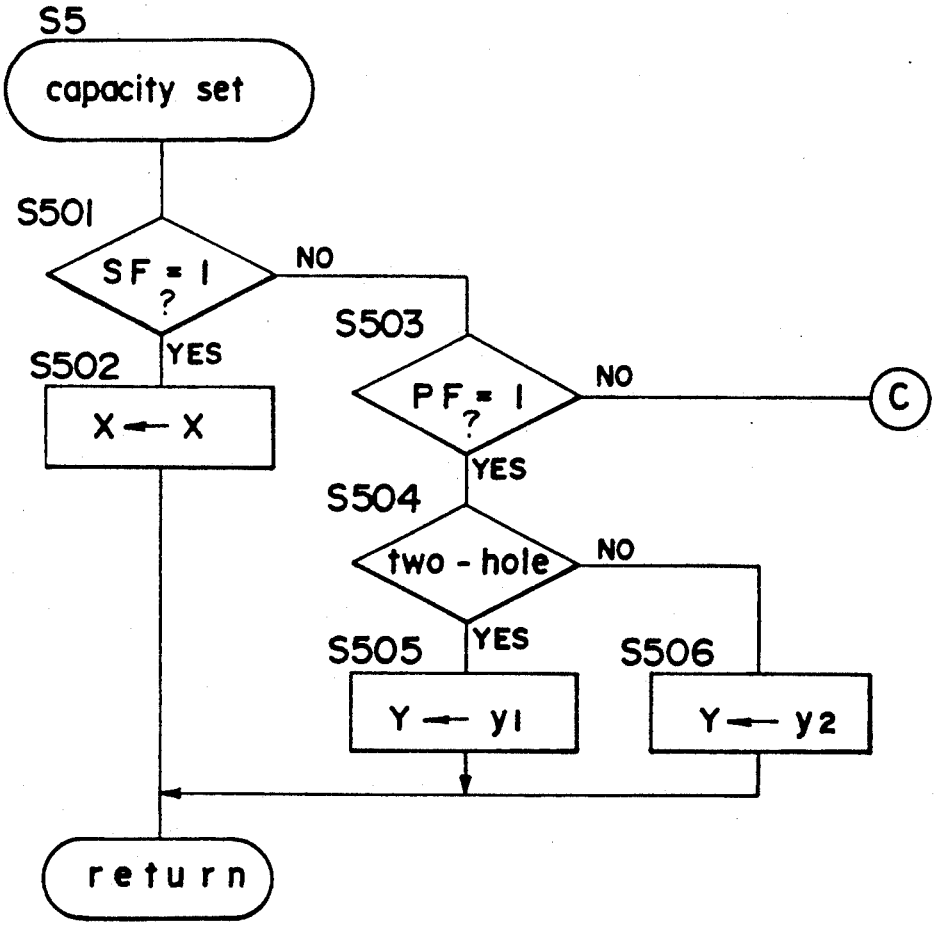
Figure 11:
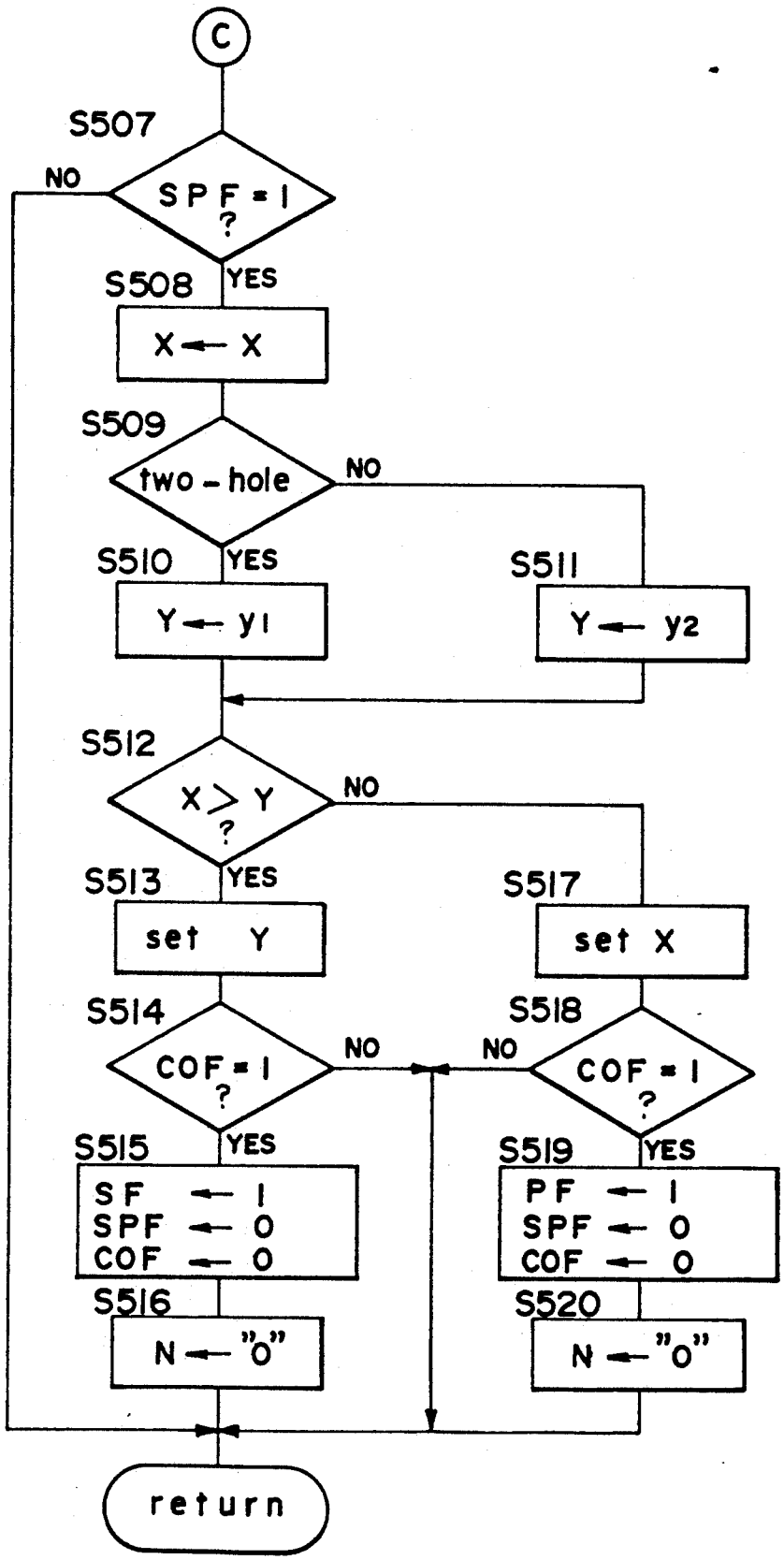

FIGS. 10 and 11 show the capacity setting subroutine executed in step S5.

The currently selected finish mode is determined in steps S501, S503, and S507, and the copy sheet capacity is set in accordance with the selected finish mode.

In step S501, a check is made to determine whether or not the staple flag is set at [1]. If the reply to the query is YES, the staple process capacity of x sheets is stored in the RAM as the capacity X in step S502.

A check is made in step S503 to determine whether or not the punch flag PF is set at [1]. If the reply to the query is YES, a check is made in step S504 to determine whether or not the two-hole specification is set. The punch 61 is capable of two-hole specification and three-hole specification, and wither may be set in the finisher unit 50. Thus, if the two-hole specification has been set, the sheet capacity $y_1$ is stored in the RAM as the capacity Y in step S505. On the other hand, if the three-hole capacity has been set, the sheet capacity $y_2$ is stored in the RAM as the capacity Y in step S506.

Furthermore, a check is made in step S507 to determine whether or not the staple/punch flag SPF is set at [1]. If the reply to the query is YES, the sheet capacity x of the staple process is stored in the RAM as the capacity X in step S508, and either the sheet capacity $y_1$ or sheet capacity $y_2$ is stored in the RAM as the capacity Y in steps S510 or S511, respectively. Then, in step S512, the capacities X and Y are compared, and if capacity Y is less than capacity X, the capacity Y is stored in the RAM as the adjustable tray 57 capacity in step S523. On the other hand, if the capacity X is equal to or less than the capacity Y, the capacity X is stored in the RAM as the adjustable tray 57 capacity in step S517. That is, when the capacities X and Y are different, the smaller value is set as the maximum number of sheets that are processable in the staple/punch mode.

The maximum number of processable sheets x, $y_1$ and $y_2$ in the respective finish modes are stored in the read only memory (ROM) of the CPU 101. Of course, the aforesaid values of x, $y_1$ and $y_2$ also may be stored in the RAM. In such a case,it is desirable to use a RAM of the nonvolatile type.

Next, in steps S514 and step S518, checks are made to determine whether or not capacity-over flag COF is set at [1]. The capacity-over flag COF is set at [1] when the originals fed during the counting of the number of sheets of originals in the RDH 30 reaches either capacity X or capacity Y (refer to step S1405). Therefore, the reply to the queries of steps S514 and S518 is NO until the number of fed originals reaches the capacities X or capacity Y stored in memory, and this subroutine ends. On the other hand, when the maximum number of processable sheets is reached and the reply to the query of step S514 or step S518 is YES and the punch process capacity is smaller, the staple flag SF is set at [1], the staple/punch flag SPF is reset at [0], and the capacity-over flag COF is reset at [0] in step S515. Then, in step S516, the value of the document counter N (refer to step S1402) is reset to zero ("0"). When the staple process capacity is smaller, the punch flag is set at [1], the staple/punch flag is reset at [0], and the capacity-over flag is reset at [0] in step S519. Then, in step S520, the value of the document counter N is reset to zero ("0").

In the aforesaid controls, when the staple mode and the punch mode are simultaneously selected, the maximum number of processable sheets of the mode having the smaller capacity is set as the sheet capacity. Therefore, when the number of sheets accommodated in the adjustable tray 57 reaches the aforesaid smaller sheet capacity, finish mode is automatically switched to the mode having the higher capacity. Thereafter, the sheet capacity is reset to the capacity of the switched finish mode (refer to steps S502, S505, S506).

Figure 12:
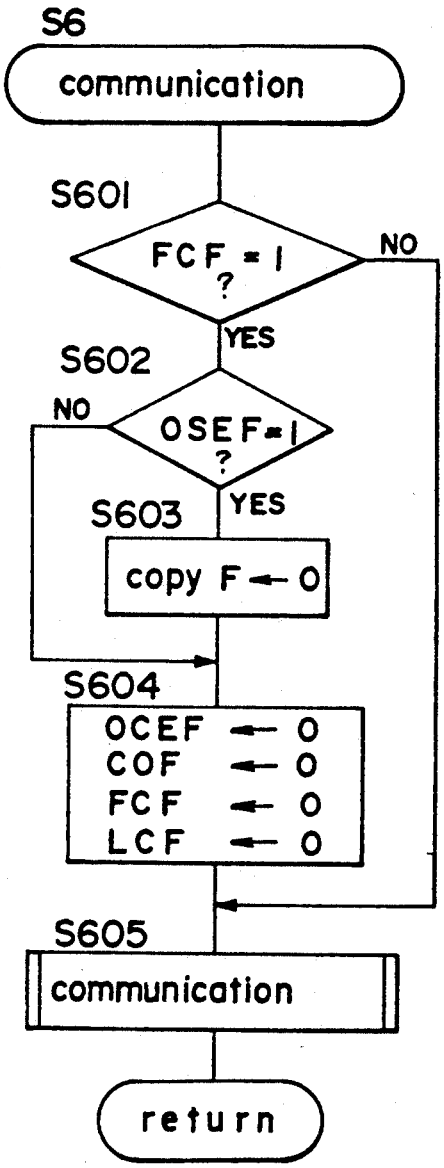

FIG. 12 shows the subroutine for communication with the other CPUs executed in step S6.

First, a check is made in step S601 to determine whether or not the finish complete flag FCF is set at [1]. The finish complete flag FCF is set at [1] when one set of finish processed is discharged to the stacker 67 (refer to step S2803). If the finish complete flag FCF has been reset at [0], and the one-set end flag OSEF is verified as set at [1] in step S602, the copy flag is reset at [0] in step S603.

Then, in step S604, the one-cycle end flag OCEF, capacity-over flag COF, finish complete flag FCF, and last cycle flag LCF are all reset at [0].

In step S605, other communication processes are executed.

Figure 13:
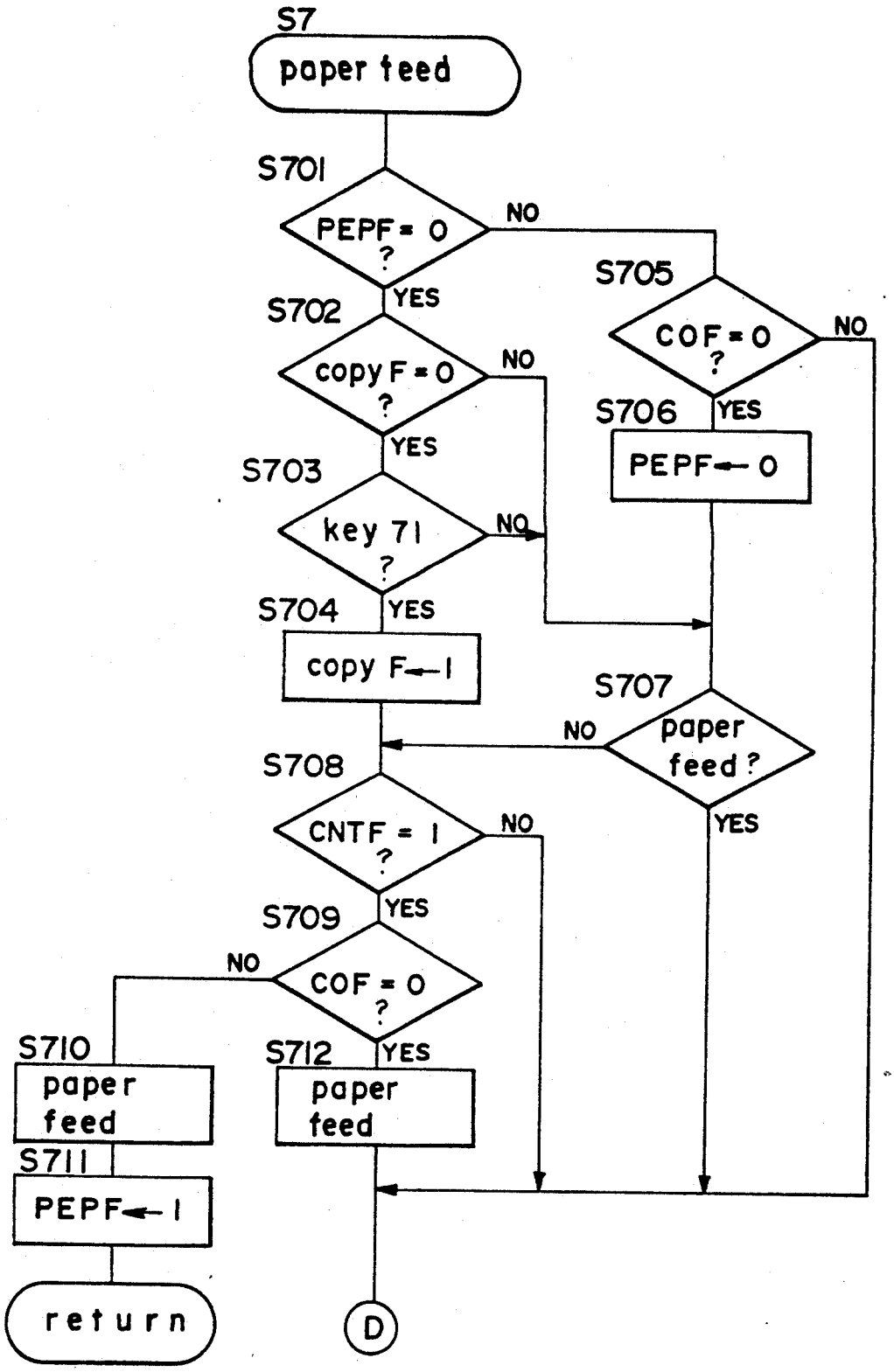
Figure 14:
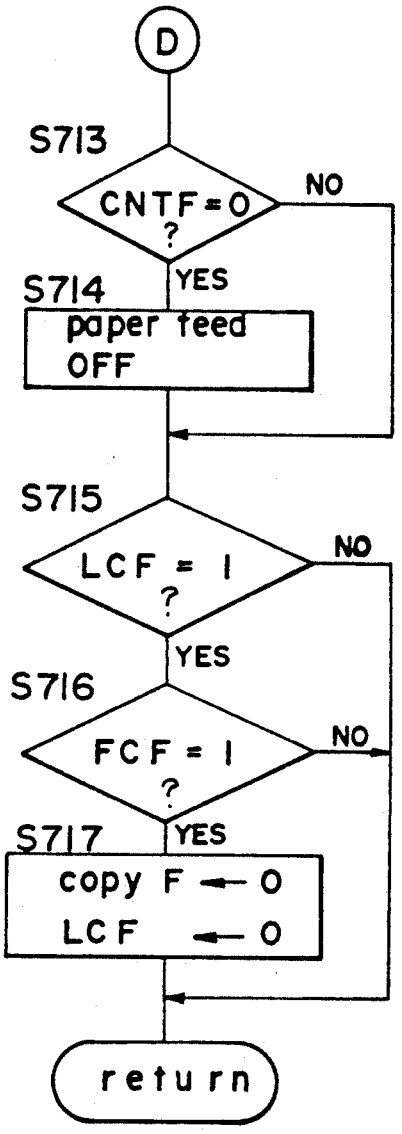

FIGS. 13 and 14 show the paper feed subroutine executed in step S7.

In this subroutine, a check is first made in step S701 to determine whether or not the paper feed prohibit flag PEPF is set at [0]. The paper feed prohibit flag PEPF is set at [1] when the number of fed originals reaches the capacity X or capacity Y (refer to step S711). Accordingly, if the paper feed prohibit flag PEPF is set at [1], a check is made in step S705 to ascertain whether or not the capacity-over flag COF is set at [0]; if the flag COF is set at [1], the routine advances to step S713. If the paper feed prohibit flag PEPF has been reset at [0], the copy flag is checked in step S702 to determine whether or not it is set at [0]. If the copy flag has been reset at [0], i.e., if a copy process or finish process is not currently on-going, the copy start key 71 is checked to determine whether or not it is ON-edge in step S703. The subroutine advances to step S707 if the reply to the query of step S702 or S703 is NO, i.e., if a copy process or finish process is currently on-going, or if neither process is on-going and the copy start key 71 is not turned ON.

Then, when the ON-edge state of the copy start key 71 is confirmed in step S703, the copy flag is set at [1] in step S704, and a check is made in step S708 to determine whether or not the count flag CNTF is set at [1]. The count flag CNTF is set at [1] when the sensor SE4 detects the leading end of the fed original (refer to step S1403), and is reset at [0] when the sensor SE4 detects the trailing end of said fed original (refer to step S1407). If the count flag CNTF is set at [1], the capacity-over flag COF is checked in step S7, and if said capacity-over flag COF has been reset at [0], the sheet feeding operation is started in step S712. If the capacity-over flag COF is set at [1], the sheet feeding operation is started in step S710, and the paper feed prohibit flag PEPF is set at [1] in step S711.

That is, if the number of sheets of the fed originals reaches the maximum capacity, the copy process is not executed for said originals, and subsequent sheet feeding is prohibited. On the other hand, if the capacity-over flag COF is reset at [0] after the paper feed prohibit flag PEPF is set at [1] (step S705: YES), the paper feed prohibit flag PEPF is reset at [0] in step S706. Thereafter, when the paper feed drive ON state is confirmed in step S707, the subroutine advances to step S713.

Next, a check is made in step S713 to determine whether or not the count flag CNTF is set at [0]. If the flag CNTF is set at [0], the paper feed drive is stopped in step S714. Then, the last cycle flag LCF is checked in step S715 to ascertain whether or not it is set at [1]. If the flag LCF is set at [1], i.e., if the copy process is currently executing for the las sheet of the set copy number (step S414), and if the finish complete flag FCF is confirmed to be set at [1] in step S716, the copy flag and last cycle flag LCF are reset at [0] in step S717.

Figure 15:
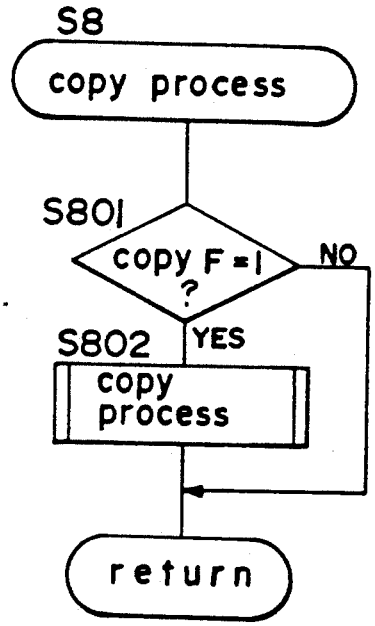
Figure 16:
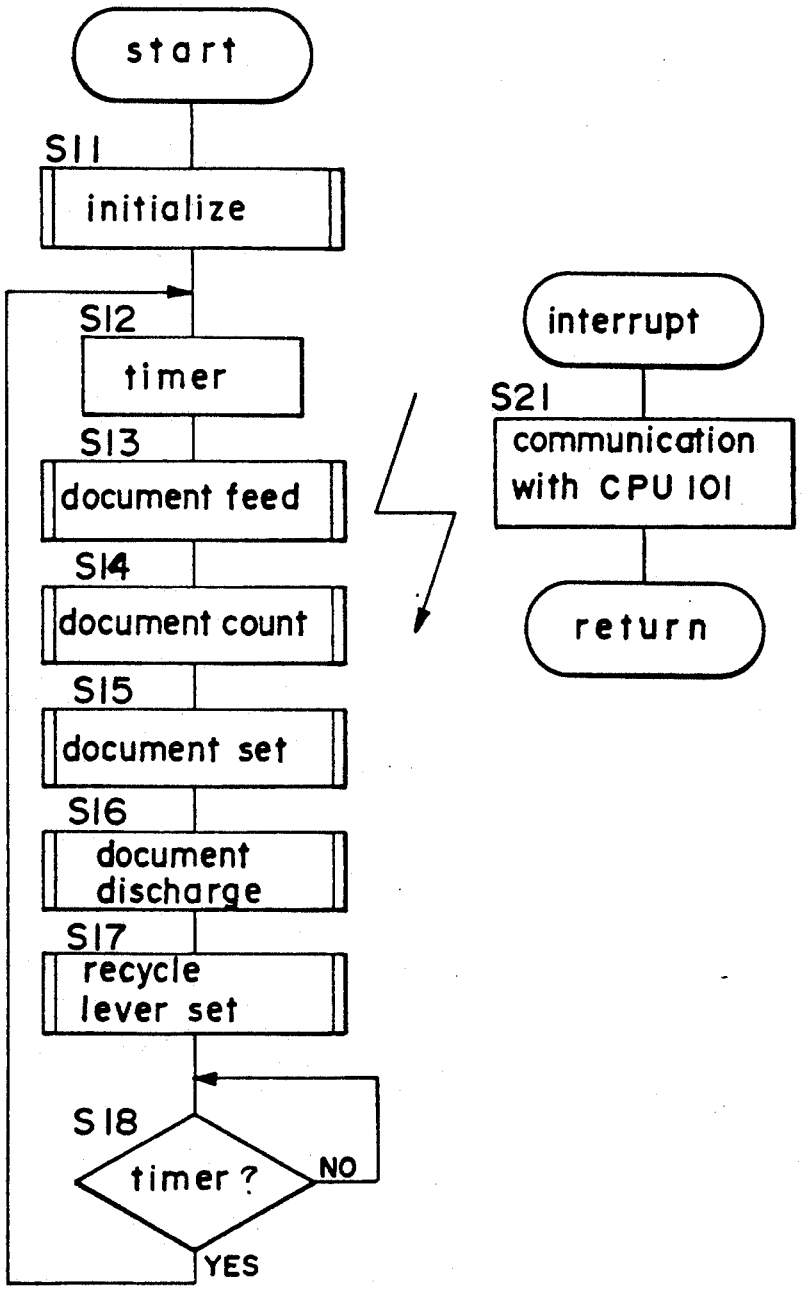

FIG. 15 shows the copy process subroutine executed in step S8.

In this subroutine, a check is made in step S801 to determine whether or not the copy flag is set at [1]. The copy process is executed in step S802 only when the copy flag is found to be set at [1] in step S801. The copy process is a continuous image formation/sheet transport process accomplished in the main unit 1 of the copying apparatus, and is further accomplished by well known controls. Therefore, details of the aforesaid controls are omitted from the present description.

Figure 18:
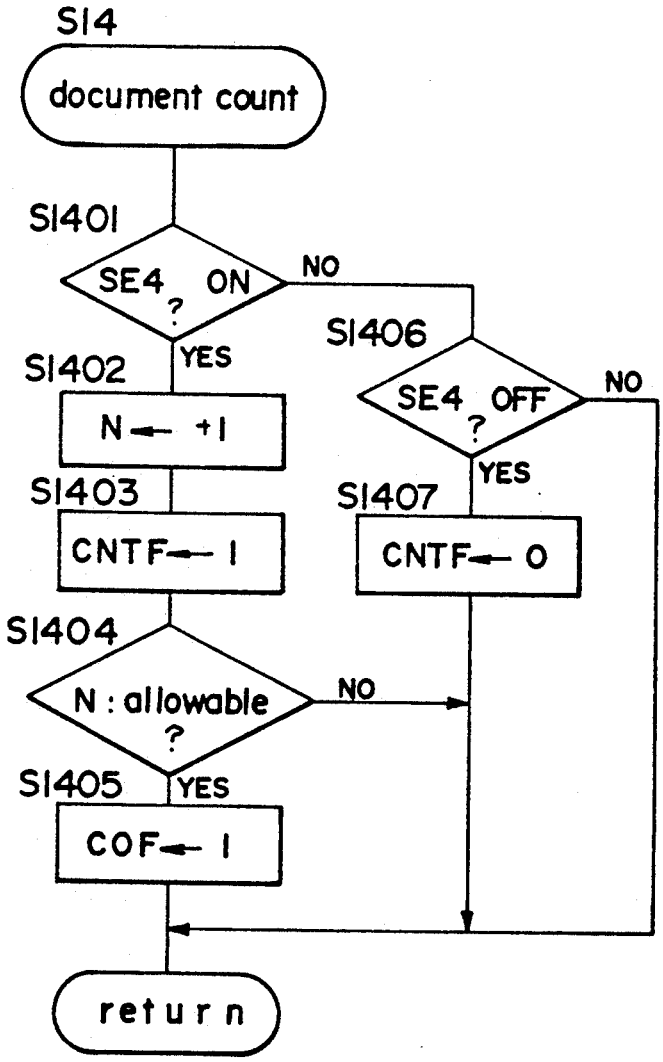

FIG. 18 shows the main routine of the CPU 102 for controlling the RDH 30.

When the power source is turned ON and the program of the CPU 102 starts, first, in step S11, initialization is executed to clear the RAM, reset the various types of registers, and set the initial modes for the various types of components. In step S12, an internal timer is started. This internal timer determines the time required for one routine of the main routine, and the value set in said timer is set in step S11.

Then, the various subroutines of steps S13~S17 are sequentially called, and the end of the internal timer is awaited in step S18. After the end of the internal timer, the routine returns to step S12.

In step S13, the originals are fed one sheet at a time form the original tray 31 or the recycle tray 37. In step S14, the number of fed originals is counted. In step S15, the fed originals are set at a predetermined position on the platen glass 29. In step S16, the originals are discharged from the platen glass 29 to the recycle tray 37. In step S17, the recycle lever 41 is set to separate the originals and detect the last original fed.

When an interrupt request is output from the CPU 101 for controlling the main unit 1 of the copying apparatus, the CPU 102 communicates with the CPU 101 whenever required in step S21.

Figure 17:
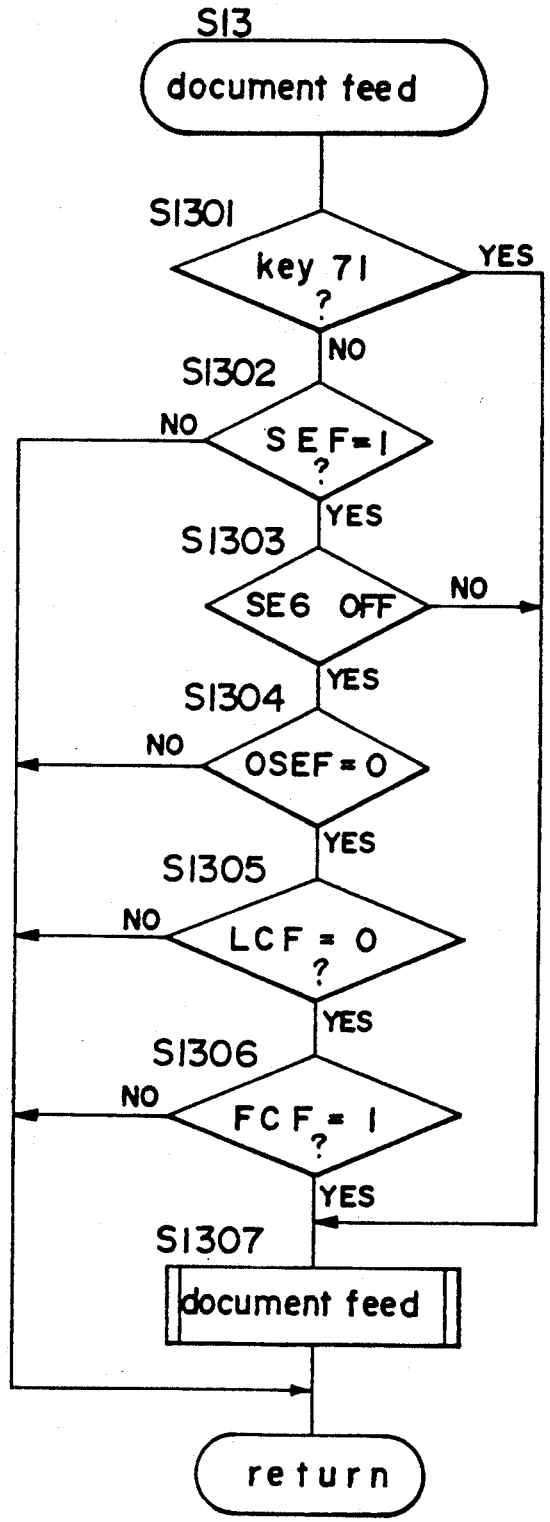

FIG. 17 shows the original document feeding subroutine executed in step S13.

First, a check is made i step S1301 to determine whether or not the copy start key 71 is ON-edge. If the key 71 is ON-edge, the original documents are fed in step S1307. If this is the copy process of one set, the last page of the original document is fed in step S1307. After the copy process of one set ends, the copy process is temporarily stopped, and if the copy start key 71 is turned ON for the copy process of a second set, the last page of the original is fed from the recycle tray 37.

If the copy start key 71 is not ON-edge, a check is made in step S1302 to determine whether or not the scan end flag SEF is set at [1]. The scan end flag SEF is set at [1] in the CPU (not illustrated) for controlling the optical unit 3 when the scanning of the first original by the optical unit 3 ends, and said state is communicated to the CPU 102 through the CPU 101. Accordingly, if the scan end flag SEF has been reset at [0], this subroutine ends because scanning is still on-going, whereas if the scan end flag SEF is set at [1], a check is made to determine whether or not the recycle sensor SE6 is OFF. The recycle sensor SE6 is turned OFF when the recycle lever 41 is in the state shown in FIGS. 2*a* and 2*e*. That is, if the scanning is completed, i.e., if the recycle sensor SE6 is turned ON, the subroutine advances to step S1307 and the original is fed from the recycle tray 37.

If the recycle sensor SE6 is turned OFF, the condition is that the last original (the first page) has been fed. When the reply to the queries of steps S1304, S1305, S1306 is YES, the original is fed from the recycle tray 37 in step S1307. That is, the originals are fed when it is determined in step S1304 that the one-set end flag OSEF has been reset at [0], and it is determined in step S1305 that the last cycle flag LCF has been reset at [0], and it is determined in step S1306 that the finish complete flag FCF is set at [1]. If the one-set end flag OSEF is set (step S1304: NO), the subroutine returns to the main routine to await the turning ON of the copy start key 71. If the last cycle flag LCF is set at [1] (step S1305: NO), the subroutine returns to the main routine because the last original of the set number of copies has been fed. If the finish complete flag FCF is set at [1] (step S1306: NO), the subroutine returns to the main routine to await completion of the finish process and feed the originals in the subsequent copy cycle.

FIG. 18 shows the original document count subroutine executed in step S14.

In this subroutine, a check is made in step S1401 to determine whether or not the sensor SE4 is ON-edge. If the sensor SE4 is found to be ON-edge, i.e., if the sensor SE4 has detected the leading end of a fed original, the counter N is incremented in step S1402, and the count flag is set at [1] in step S1403. Then, a check is made in step S1404 to determine whether or not the counter N value is equal to the allowable capacity of processable sheets in the currently selected finish mode. If the allowable capacity is not reached, the subroutine returns to the main routine, whereas if the allowable capacity is reached, the capacity-over flag COF is set at [1] in step S1405.

If, on the other hand, the sensor SE4 is not ON-edge, a check is made in step S1406 to determine whether or not said sensor Se4 is OFF-edge. If the sensor SE4 is not OFF-edge, the subroutine returns to the main routine, whereas if the sensor SE4 is OFF-edge, i.e., if the sensor SE4 has detected the trailing end of a fed original, the count flag CNTF is reset at [0] in step S1407.

Figure 19:
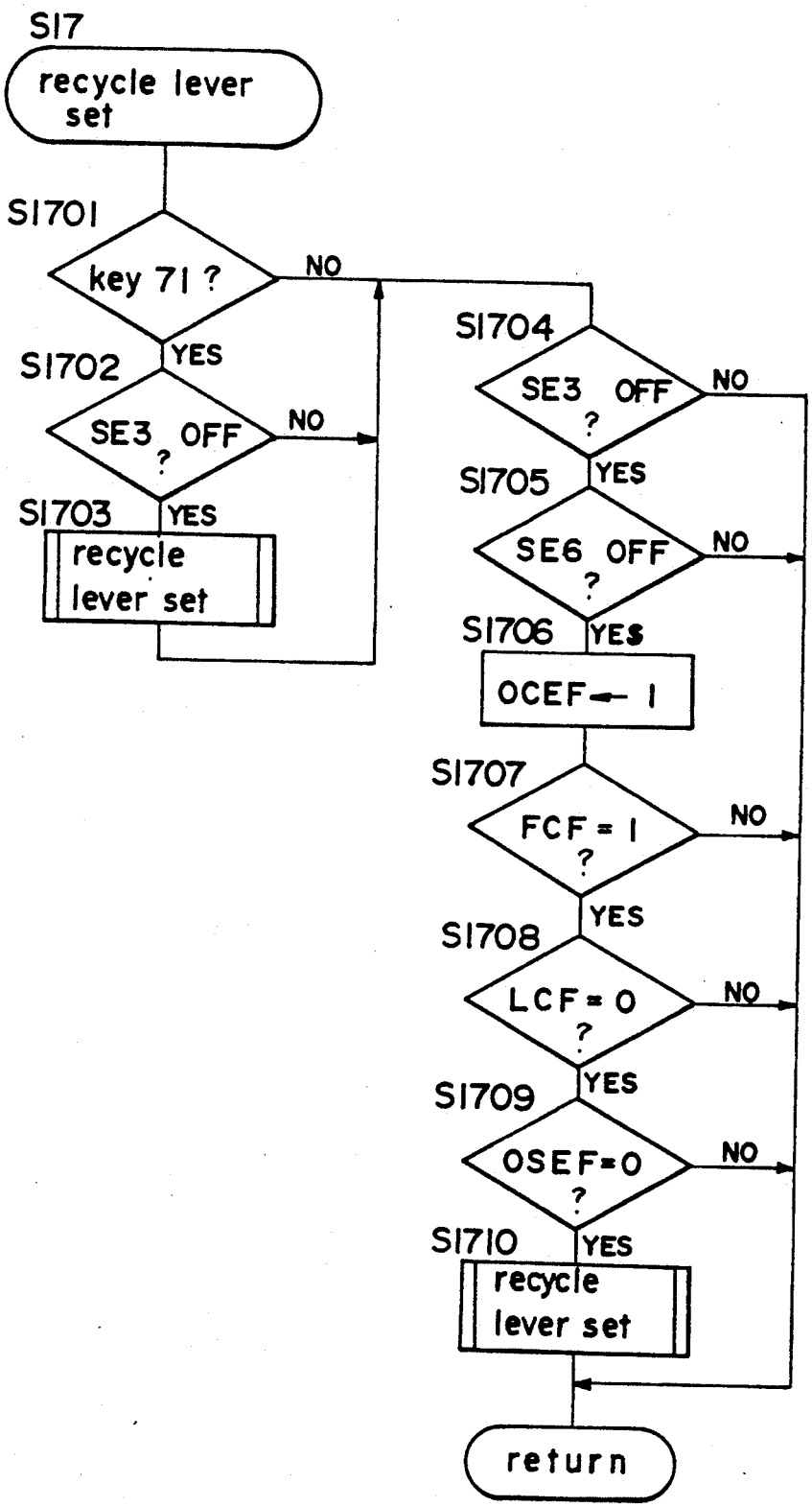

FIG. 19 shows the recycle lever setting subroutine executed in step S17.

First, when the ON-edge state of the copy start key 71 is confirmed in step S1701, a check is made in step S1702 to ascertain whether or not the sensor SE3 is turned OFF. If the sensor SE3 is turned OFF, the recycle lever 41 is set in step S1703 because all originals have been fed from the document tray 31 and are stacked on the recycle tray 37. that is, the front end of the recycle lever 41 is resting in contact with the top of the stack of originals in the recycle tray 37.

Next, checks are made in steps S1704 and S1705 to determine whether or not the respective sensors SE2 and SE6 are turned OFF. If both sensors SE2 and SE6 are turned OFF, the one-cycle end flag OCEF is reset at [1] in step S1706 because one cycle of the copy process has ended. Then, checks are made in step S1707 to determine whether or not the finish complete flag FCF is set at [1], in step S1708 to determine whether or not the last cycle flag LCF is set at [0], and step S1709 to determine whether or not the one-set end flag OSEF is set at [0]. If the reply to all the aforesaid queries is YES, i.e., if the finish process is completed for one set and the copy process for the set copy number has remaining copies and the copy process for one set has not ended, then the recycle lever 41 is set on the originals in step S1710.

Figure 20:
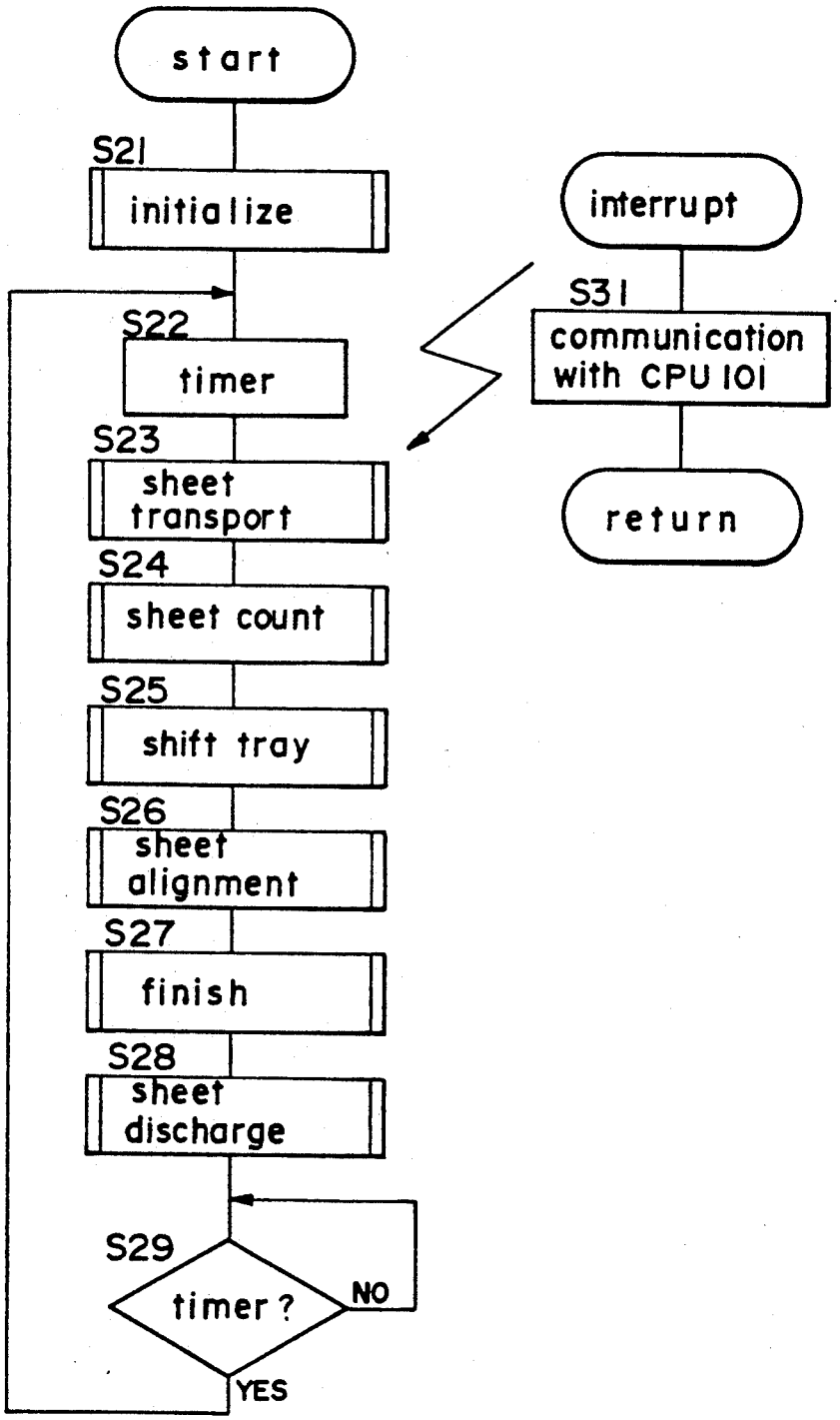

FIG. 20 shows the main routine of the CPU 103 for controlling the finisher unit 50.

When the power source is turned ON and the program of the CPU 103 starts, first, in step S21, initialization is executed to clear the RAM, reset the various types of registers, and set the initial modes for the various types of components. In step S22, an internal timer is started. This internal timer determines the time required for one routine of the main routine, and the value set in said timer is set in step S21.

Then, the various subroutines of steps S23~S28 are sequentially called, and the end of the internal timer is awaited in step S29. After the end of the internal timer, the routine returns to step S22.

In step S23, the sheet feeding system is actuated to feed the copy sheets discharged from the copying apparatus main unit 1 to the finisher unit 50. In step S24, the number of copy sheets fed to the finisher unit 50 is counted. In step S25, in the non-staple mode, the sheets are accommodated in the elevator/shift tray 55, and at the same time said shift tray 55 elevator movement and shift movement operations are accomplished. In step S26, in the staple mode and the punch mode, the sheets are accommodated in the adjustable tray 57 and aligned sheet by sheet. In step S27, the finish process is accomplished in the finish mode set for the sheets accommodated on the adjustable tray 57. In step S28, the bundled sheets are discharged form the adjustable tray 57 to the stacker 67.

Figure 21:
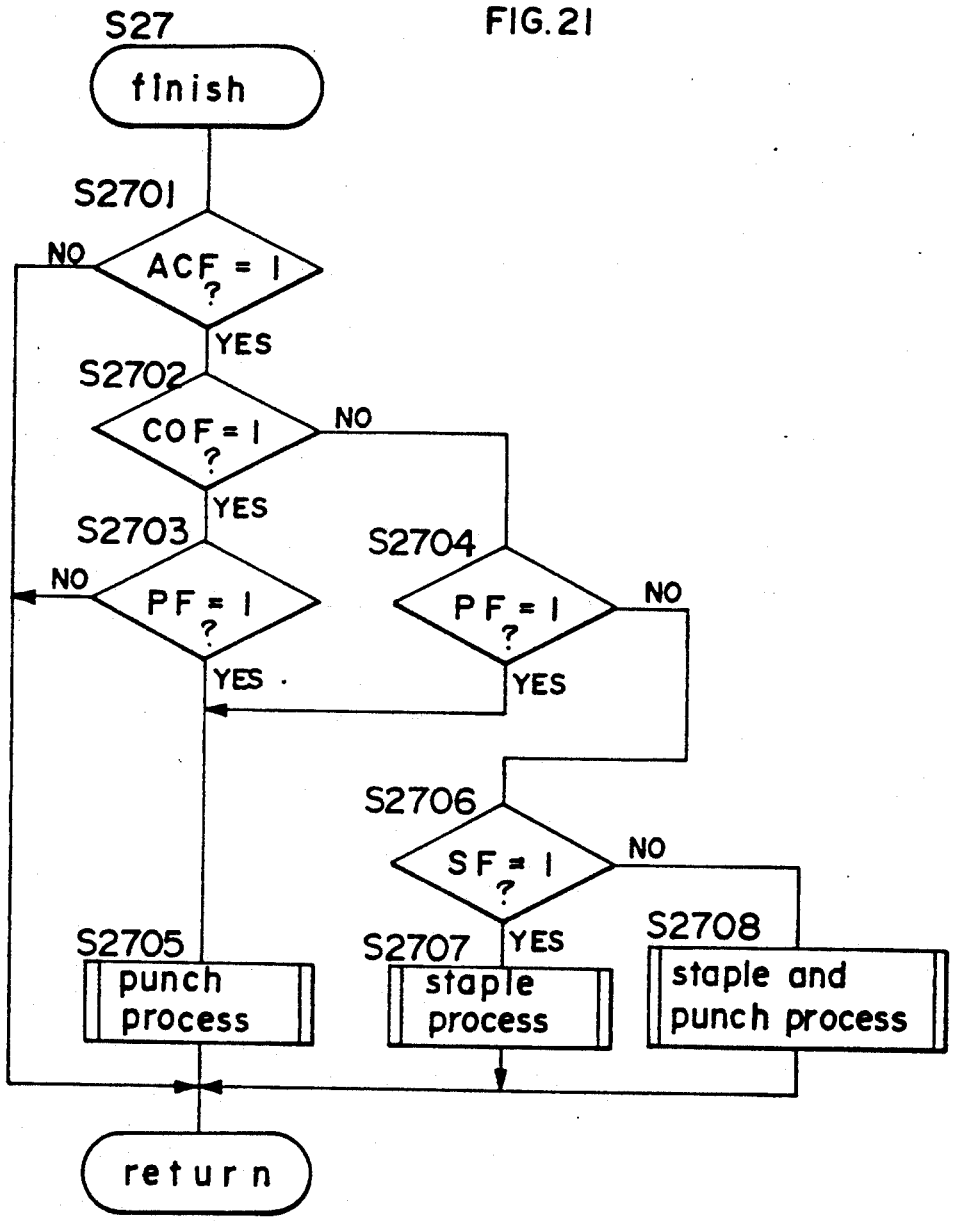

FIG. 21 shows the finish process subroutine executed in step S27.

In this subroutine, a check is first made in step S2701 to determine whether or not the alignment complete flag ACF is set at [1]. The alignment complete flag ACF is set at [1] when the sheet alignment is completed in the sheet alignment process executed in step S26 of the main routine. Accordingly, when the alignment complete flag ACF is reset at [0], the subroutine immediately returns to the main routine. If the alignment complete flag ACF is set at [1], a check is made in step S2702 to determine whether or not the capacity-over flag COF is set at [1]. If the capacity-over flag COF has been reset at [0], a check is made in step S2704 to determine whether or not the punch flag PF is set at [1], and a check is made in step S2706 to determine whether or not the staple flag SF is set at [1]. If the punch flag PF (i.e., punch mode) is currently set (step S2704: YES), the punch process is executed in step S2705 for the sheets on the adjustable tray 57. If the staple flag SF (i.e., staple mode) is set (step S2706: YES), the staple process is executed in step S2707 for the sheets. Alternatively, if the staple/punch mode is set (steps S2704, S2706: NO), the staple process and punch process are executed in step S2708 for the sheets.

If, on the other hand, the punch mode is set (steps S2702, S2703: YES), the punch process is executed for the sheets in step S2705 even when the capacity-over flag COF is set at [1].

Figure 22:
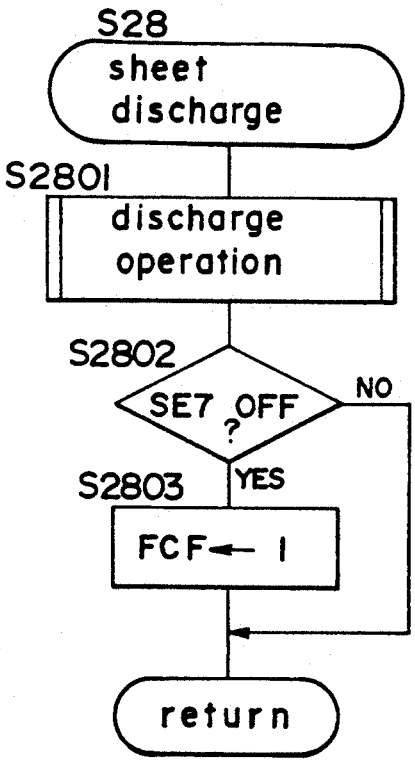

FIG. 22 shows the sheet discharge subroutine executed in step S28.

First, the sheets bundled via the finish process are discharged downwardly from the adjustable tray 57 in step S2801. At this time, the bundle of sheets is accommodated in the stacker 67. During the aforesaid accommodation, the finish complete flag FCF is set at [1] in step S2803 when the determination of step S2802 finds the sensor SE7 is OFF-edge, i.e., when said sensor SE7 has detected the trailing end of the sheet bundle being transported to the stacker 67.

Second Embodiment (refer to FIGS. 23~27)

A second embodiment of the present invention is described hereinafter with reference to FIGS. 23~27. The second embodiment uses the copying main copying unit 1, RDH 30 and finisher 50 shown in FIG. 1 as the copying apparatus, but the process for setting the maximum number of processable sheets for the original document count process and the finish process is different from the process described in the first embodiment.

In the first embodiment, the sheets of the original document are counted concurrently with the copying process executed during a one-set copy process, whereas in the second embodiment, the sheets of the original document are counted when said originals are cycled from the document tray 31 to the recycle tray 37 without executing a copying process. An alarm is generated when the number of sheets of the original document exceeds the maximum allowable number of processable sheets.

More specifically, when the staple mode or the punch mode has been selected and the number of originals is less than the maximum capacity of the staple mode or the punch mode, the copy process and the finish process are executed. However, when the number of originals is greater than the maximum capacity, a warning is displayed to alert the operator that processing in the staple mode or the punch mode is impossible.

Furthermore, when the staple/punch mode has been selected, the capacity of the mode having the smaller capacity is set as the allowable sheet capacity, and if the number of originals is equal to or less than said set sheet capacity, the copy process and finish process are executed. If the number of originals is greater than the aforesaid allowable sheet capacity, the number of sheets of originals is compared to the allowable capacity of the mode (staple mode or punch mode) having the larger capacity, and if the number of originals is equal to or less than said larger capacity, a warning is displayed to indicate that the finish process is possible for the greater capacity. If the number of originals is greater than the aforesaid capacity, a warning is displayed to indicate that neither mode is possible as the finish mode.

The number of originals for each finish mode and the controls for allowing and disallowing processing are shown in Tables 1 and 2. Table 1 shows the conditions when the allowable capacity of the staple mode is greater than that of the punch mode, and Table 2 shows the conditions under the opposite parameters.

TABLE 1

| No. of Originals | Staple Mode | Punch Mode Allowable Capacity | Staple/Punch |
|---|---|---|---|
| | 50 | 40 | 40 |
| 35 | ○ | ○ | ○ |
| 40 | ○ | ○ | ○ |
| 45 | ○ | X | Δ1 |
| 50 | ○ | X | Δ1 |
| 55 | X | X | X |

○: Processable
X: Unprocessable
Δ1: Only staple process is possible by changing the processing mode to the staple mode.

TABLE 2

| No. of Originals | Staple Mode | Punch Mode Allowable Capacity | Staple/Punch |
|---|---|---|---|
| | 40 | 50 | 40 |
| 35 | ○ | ○ | ○ |
| 40 | ○ | ○ | ○ |
| 45 | X | ○ | Δ2 |
| 50 | X | ○ | Δ2 |
| 55 | X | X | X |

○: Processable
X: Unprocessable
Δ2: Only punch process is possible by changing the processing mode to the punch mode.

Figure 23:
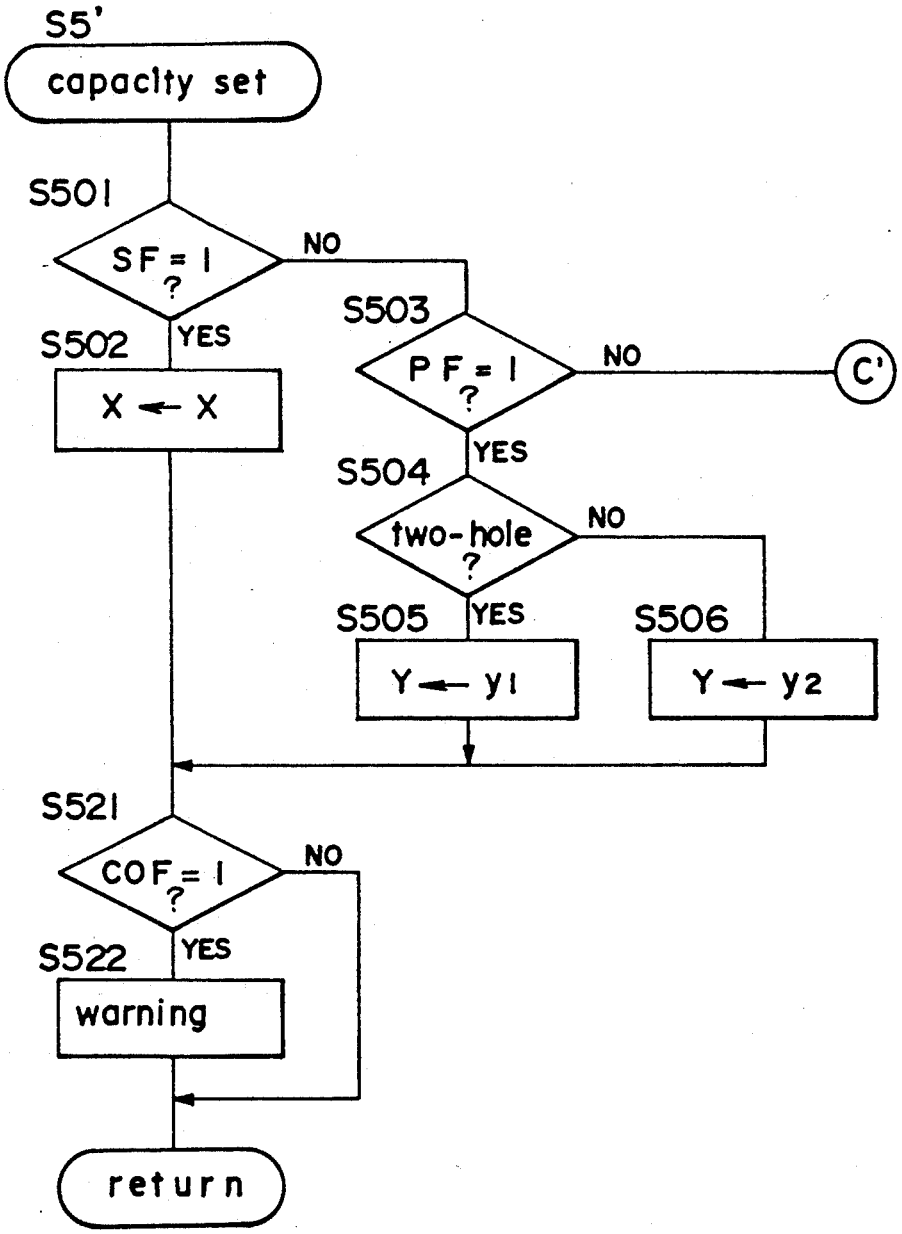
FIGS. 23 through 27 show a second embodiment.
Figure 24:
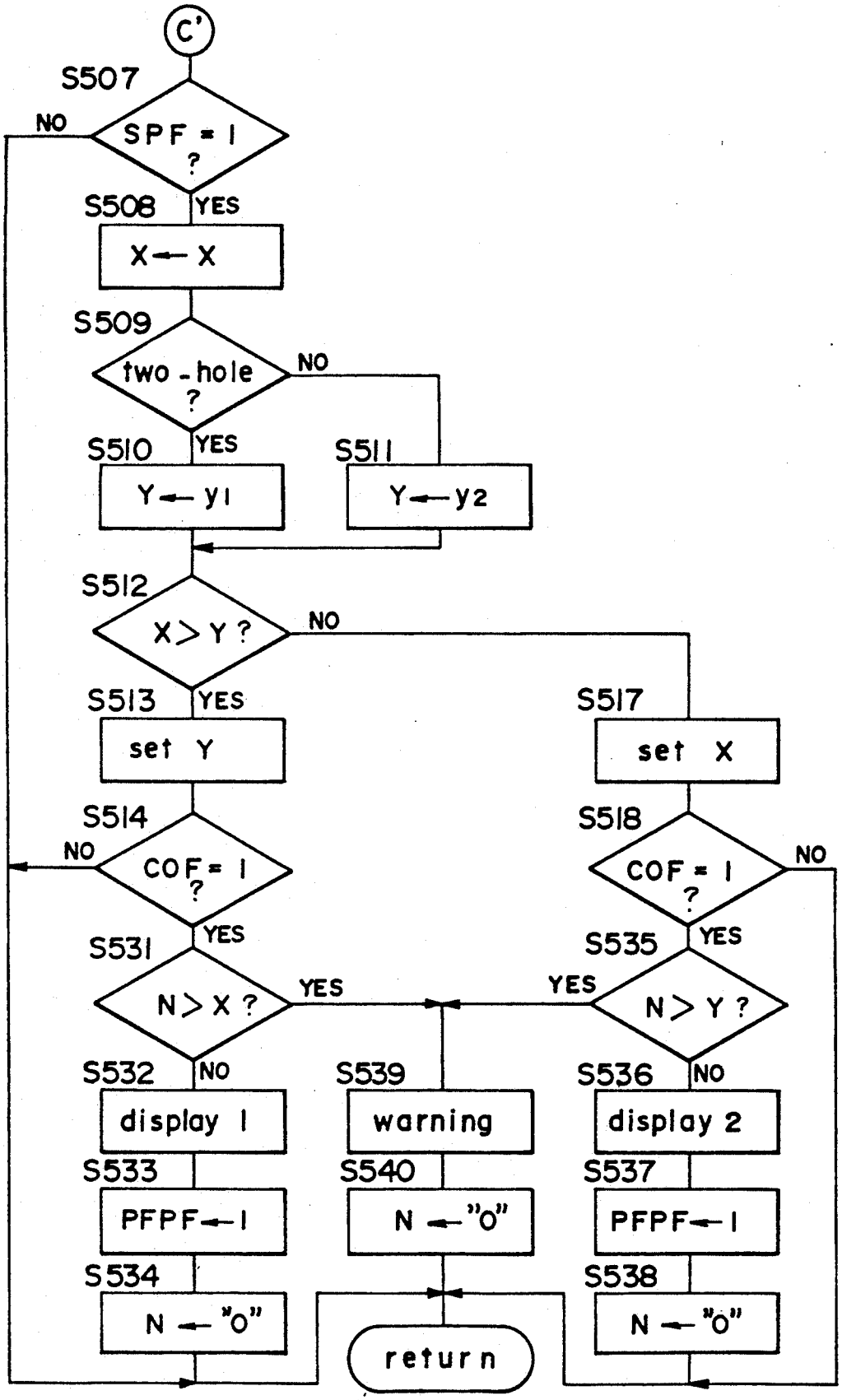

Although the control means are basically executed in accordance with the flow charts shown in FIGS. 6~22, the capacity setting subroutine in the controls of the CPU 101 is replaced by the subroutine of step S5' shown in FIGS. 23 and 24. Furthermore, the controls of the CPU 102 are replaced by the subroutines shown in FIGS. 25~27.

FIGS. 23 and 24 show the subroutine of step S5' which replaces the capacity setting subroutine (step S5) shown in FIGS. 10 and 11. The subroutine of step S5' is based on the premise that the number of originals are counted by the RDH 30 prior to the copying process. In this subroutine, steps having reference numbers in common with those of FIGS. 10 and 11 are identical processes.

In this subroutine, the allowable sheet capacity is set in accordance with the finish mode selected by an operator each time the copy process is started (steps S501 to S511). When the staple/punch mode is selected, the sheet capacity of the mode having the lesser capacity is set as the allowable capacity in the same manner as in the first embodiment.

When the staple mode is selected or the punch mode is selected (step S501 or S503: YES), a check is made in step S521 to determine whether or not the capacity-over flag COF is set at [1]. If the flag COF has been reset at [0], the subroutine returns to the main routine, whereas if the flag COF is set at [1], a warning is displayed in step S522. This warning display is accomplished by flashing the LED 92 or LED 93 shown in FIG. 4.

When, on the other hand, the staple/punch mode is selected (step S507: YES), a check is made in step S514 or S518 to determine whether or not the capacity-over flag COF is set at [1]. When the flag COF is set at [1] and the capacity of the staple mode is greater (step S512: YES), the number of originals N and the capacity X of the staple mode are compared in step S531. If N>X, a warning is displayed in step S539, and the value of the document counter N is reset at [0] in step S540. The warning display is accomplished by flashing the LED 94 shown in FIG. 4 in step S539. If N≦X, a display is generated which indicates that the staple mode alone is possible in step S532 (e.g., the LED 94 may flash rapidly, or the LED 92 may flash slowly), and the paper feed prohibit flag is set at [1] in step S533. Then, the value of the document counter N is reset at [0] in step S534. When the capacity of the punch mode is greater (step S512: NO), the number of originals N and the capacity Y of the punch mode are compared in step S535. If N>Y, the warning display is generated and counter N is reset as previously described in steps S539 and S540. If N≦Y, a display is generated which indicates the punch mode alone is possible in step S536 (e.g., the LED 94 may flash rapidly, or the LED 93 may flash slowly), and the paper feed prohibit flag is set at [1] in step S537. Then, the value of the document counter N is reset at [0] in step S538.

Figure 25:
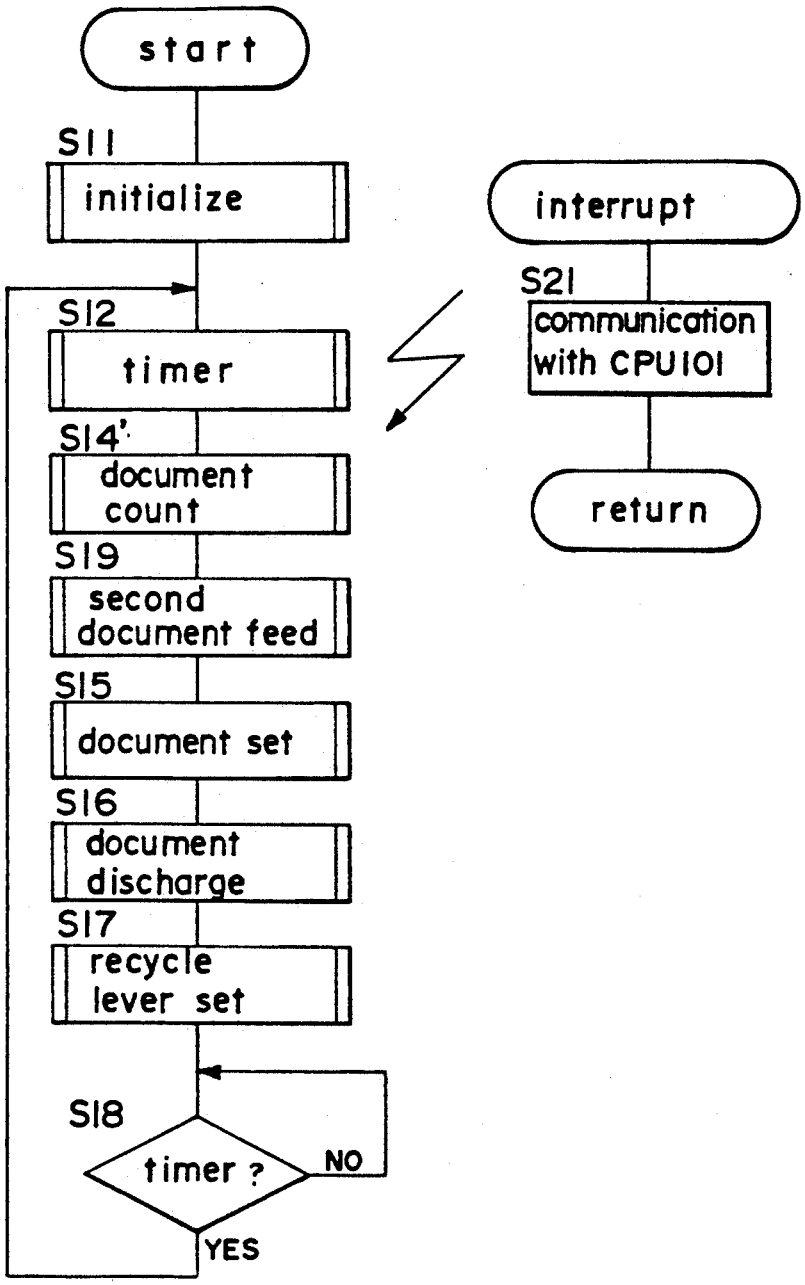

FIG. 25 shows the main routine of the CPU 102 for controlling the RDH 30.

In this main routine, the steps S12, S15, S16, S17, S18, and S21 are identical to the control sequences of the previously described first embodiment. The document count subroutine of aforesaid step S14 is replaced by the subroutine of step S14' shown in FIG. 26; the original document feed subroutine of the aforesaid step S13 has been omitted, and a new second original document feed subroutine has been inserted as step S19.

Figure 26:
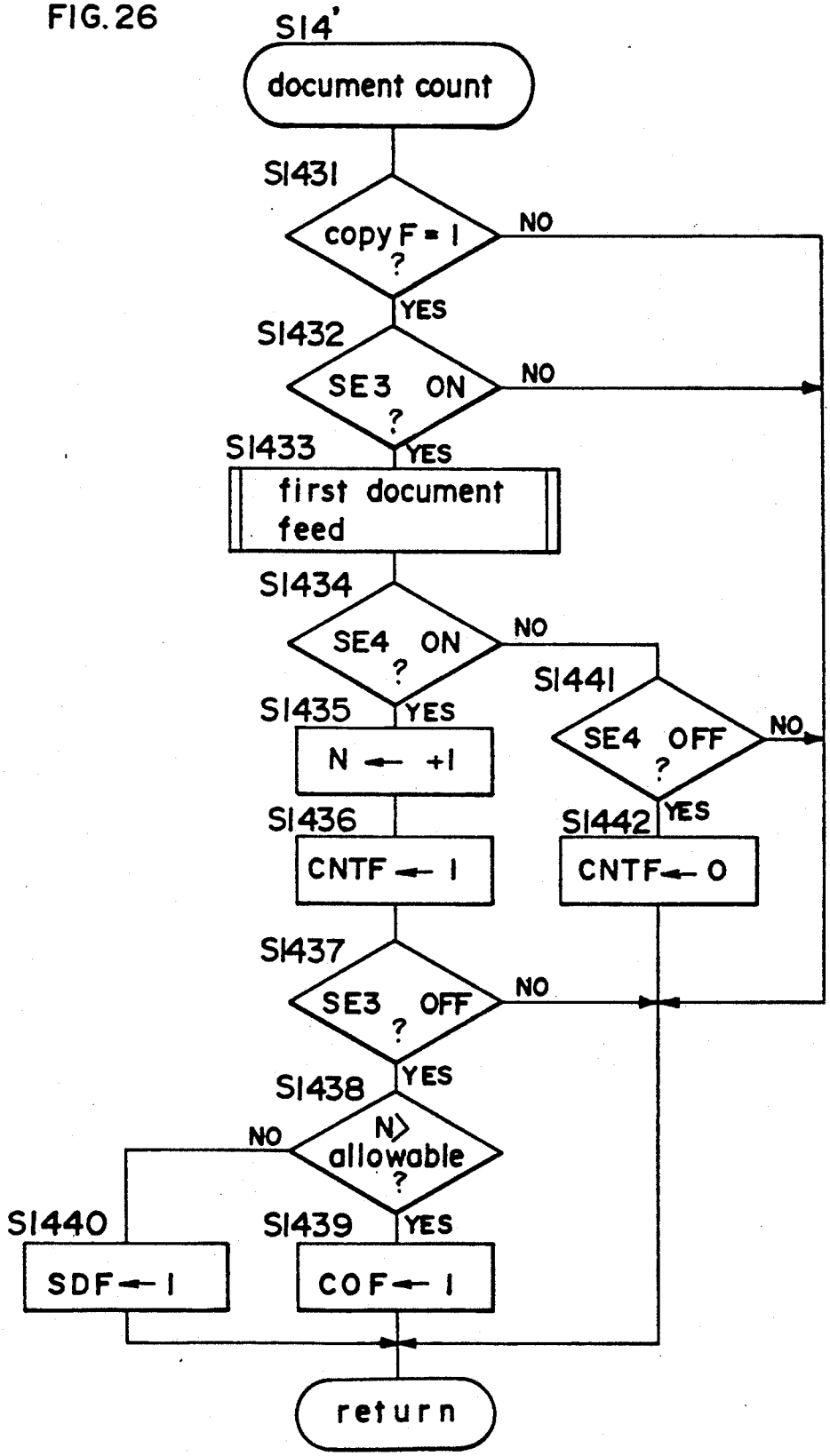

FIG. 26 shows the document count subroutine executed in step S14'.

First, a check is made in step S1431 to determine whether or not the copy flag is set at [1], and a check is made in step S1432 to determine whether or not the sensor SE3 is turned ON. If the copy start key 71 is not turned ON, or original documents are not placed on the document tray 31, the subroutine immediately ends. If the reply to the queries of steps S1431 and S1432 is YES, i.e., if a copy process has started and originals are place don the document tray 31, the first document feed is accomplished in step S1433. At this time, the process feeds one sheet of the original document from the document tray 31 past the platen glass 29 to the recycle tray 37. The process described below is executed when the original passes the detection point of the sensor SE4.

A check is made in step S1434 to determine whether or not the sensor SE4 is ON-edge. If the sensor SE4 is ON-edge, i.e., if the leading end of the fed original is detected by the sensor SE4, the counter N is incremented in step S1435, and the count flag CNTF is set at [1] in step S1436. Then, a check is made in step S1437 to determine whether or not the sensor SE3 is turned OFF. If the sensor SE3 is turned ON, the subroutine returns once to the main routine for the feeding of the next original. If the sensor SE3 is turned OFF, the value of the counter N and the allowable capacity of the finish mode previously set are compared in step S1438. If the number of originals exceeds the allowable capacity, the capacity-over flag COF is set at [1] in step S1439. If the number of originals is less than the allowable capacity, the second document feed flag SDF is set at [1] in step S1440. The second document feed flag SDF is set at [1] in step S1440 when the number of originals is less than the allowable capacity, and starts the process for feeding an original (second document feed) from the recycle tray 37 for the copy process.

If, on the other hand, the sensor SE4 is not ON-edge, a check is made in step S1441 to determine whether or not the sensor SE4 is OFF-edge. If the sensor SE4 is not OFF-edge, the subroutine returns to the main routine, whereas if the sensor SE4 is OFF-edge, i.e., if the trailing end of the original has been detected by the sensor SE4, the count flag CNTF is reset at [0] in step S1442.

Figure 27:
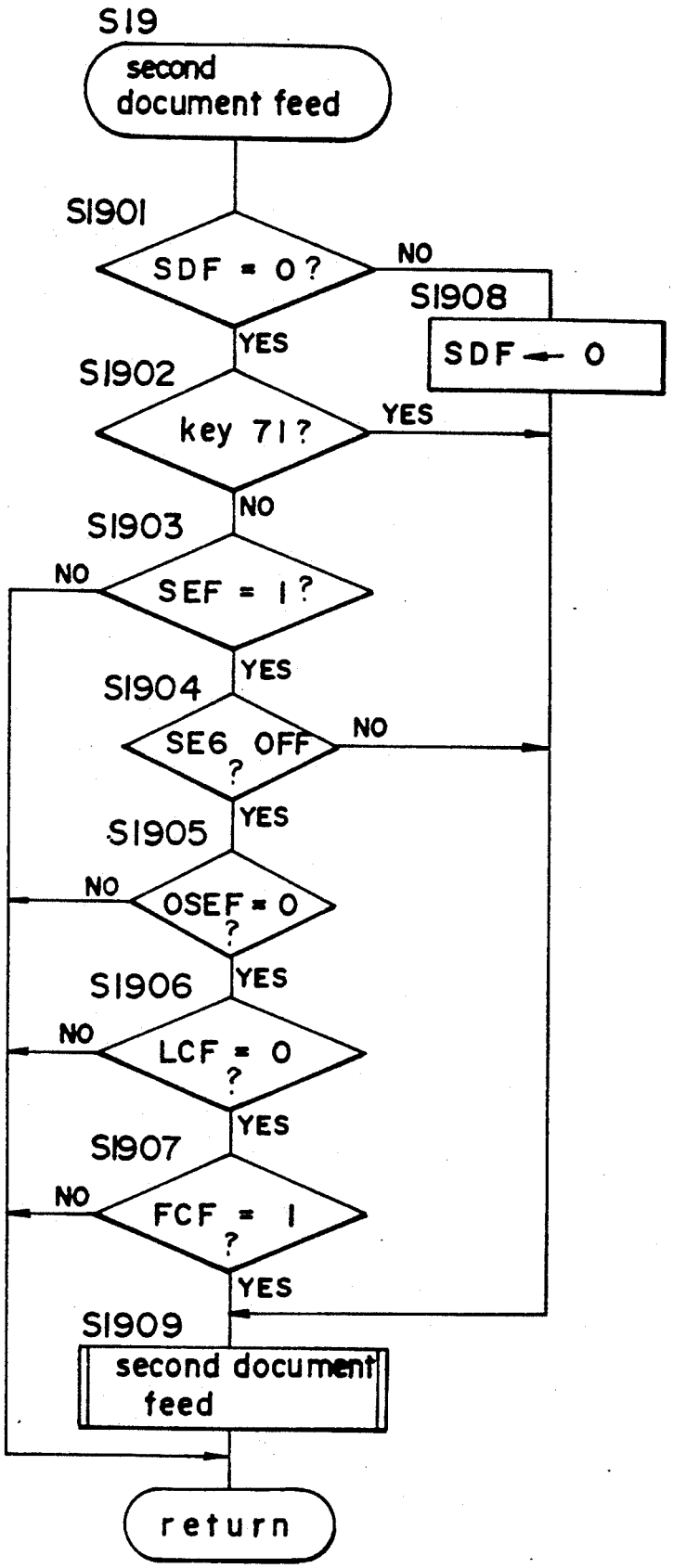

FIG. 27 shows the second document feed subroutine executed in step S19.

First, a check is made in step S1901 to determine whether or not the second document feed flag SDF is set at [0]. If the flag SDF is set at [1], it is reset at [0] in step S1908, and the second document is fed in step S1909. This process feeds a single sheet of the original from the recycle tray 37. Thereafter, the original document is stopped at a predetermined position on the platen glass 29, the image is scanned, and the document is subsequently returned again to the recycle tray 37.

If the second document feed flag SDF has been reset at [0], a check is made in step S1902 to determine whether or not the copy start key 71 is ON-edge. If the key 71 is ON-edge, the routine advances to the previously described step S1909, and an original is fed from the recycle tray 37. If the copy start key 71 is not ON-edge, i.e., when an original subsequent to the second sheet is fed, a check is made in step S1903 to determine whether or not the scan end flag SEF is set at [1]. If the scan end flag SEF is set at [1] and the recycle sensor SE6 is found to be turned ON in step S1904, the routine advances to step S1909, and next original is fed from the recycle tray 37.

If the recycle sensor SE6 is turned OFF and the reply to the queries of steps S1905, S1906 and S1907 is YES, an original is fed from the recycle tray 37 in step S1909 for the next one-cycle copy process. That is, when the recycle sensor SE6 is turned OFF (when a document has cycled), an original document is fed after the finishing process is completed rather than when the one-set copying ends, or after the last cycle.

Although the copying apparatus 1 has been described in the preceding embodiments as using an optical system for document image scanning using visible light, it is to be noted that the document image may be read via a digital method, and the read image data may be exposed on the surface of a photosensitive member by a laser beam, or image data transmitted from a host computer may be exposed on the surface of a photosensitive member by a laser beam. In cases wherein the image data are transmitted to a printer from another device, the RDH 30 is not required.

Furthermore, the sheet processing of the finisher unit may include various processes other than the staple process and punch process, such as a pasting process, stamping process and the like.

The finisher unit may be provided with a sorter function for sorting the pages of the copied document.

Although the present invention has been described with the preferred embodiment thereof, it is to be noted that various changes and modifications are apparent to those skilled in the art. Such changes and modifications are to be understood as included within the scope of the present invention as defined by the appended claims, unless they depart therefrom.

What is claimed is:

1. An image forming apparatus comprising:

an image forming device which forms images on copy sheets;

a sheet processing device which receives copy sheets bearing an image formed thereon and processes them, said sheet processing device includes a first sheet processor which is capable of processing at most X sheets of copy sheets at one time and a second sheet processor which is capable of processing at most Y sheets of copy sheets at one time;

a mode selector which selects one mode among a first mode, a second mode and a third mode; and a controller which operates said first processor and said second processor in response to said mode selector such that:

said controller operates said first sheet processor without operating said second sheet processor and sets X as a maximum number of copy sheets to be processed when said first mode is selected;

said controller operates said second sheet processor without operating said first sheet processor and sets Y as a maximum number of copy sheets to be processed when said second mode is selected; and said controller operates both said first processor and said second processor and sets one of either X or Y, whichever is smaller than the other, as a maximum number of copy sheets to be processed when said third mode is selected.

2. The image forming apparatus as claimed in claim 1, wherein said first sheet processor makes holes in the copy sheets, and the maximum number of copy sheets which said first sheet processor can make holes in is X.

3. The image forming apparatus as claimed in claim 1, wherein said second sheet processor staples the copy sheets, and the maximum number of copy sheets said second sheet processor can staple is Y.

4. The image forming apparatus as claimed in claim 1, further comprising:

a memory which stores said numbers X and Y.

5. The image forming apparatus as claimed in claim 4, wherein said controller sets the maximum number of copy sheets to be processed based on the number stored in said memory.

6. An image forming apparatus comprising:

an image forming device which forms images on copy sheets;

a sheet processing device which receives copy sheets bearing an image formed thereon and processes them, said sheet processing device includes a first sheet processor which is capable of processing at most X sheets of copy sheets at one time and a second sheet processor which is capable of processing at most Y sheets of copy sheets at one time, wherein said maximum number Y is larger than said maximum number X;

a mode selector which selects one mode among a first mode, a second mode and a third mode; and a controller which operates said first processor and said second processor in response to said mode selector such that:

said controller operates said first sheet processor without operating said second sheet processor and sets X as a maximum number of copy sheets to be processed when said first mode is selected;

said controller operates said second sheet processor without operating said first sheet processor and sets Y as a maximum number of copy sheets to be processed when said second mode is selected; and said controller operates both said first processor and said second processor and sets X as a maximum number of copy sheets to be processed when said third mode is selected; and said controller automatically changes said third mode to said second mode when the number of copy sheets fed to the sheet processing device is larger than X.

7. The image forming apparatus as claimed in claim 6, wherein said controller sets Y as the maximum number of copy sheets when said controller sets said second mode.

8. The image forming apparatus as claimed in claim 6, further comprising:

a sheet detector which detects copy sheets fed from said image forming device to said sheet processing device; and a counter which counts the number of the copy sheets fed to the sheet processing device in response to the sheet detector.

9. The image forming apparatus as claimed in claim 8, wherein said controller changes said third mode to said second mode when a count of said counter exceeds X during an operation of the image forming apparatus in the third mode.

10. An image forming apparatus comprising:

an image forming means for forming images on copy sheets;

a sheet processing means for receiving copy sheets bearing an image formed thereon and processing them, said sheet processing means executes a first sheet process and a second sheet process, wherein said sheet processing means is capable of processing at most X sheets of copy sheets at one time by said first process and at most Y sheets of copy sheets at one time by said second process;

a mode selecting means for selecting one mode among a first mode, a second mode and a third mode;

a control means for controlling said sheet processing means such that said sheet processing means executes said first sheet process without executing said second sheet process when said first mode is selected and that said sheet processing means executes said second sheet process without executing said first sheet process when said first mode is selected and that said sheet processing means executes both said first sheet process and said second sheet process when said third mode is selected;

capacity setting means for setting X as a maximum number of copy sheets to be processed in the first mode, setting Y as a maximum number of copy sheets in the second mode, and setting one of either X and Y, whichever is smaller than the other, in the third mode.

11. An image forming apparatus comprising:

an image forming device which forms images on copy sheets;

a sheet processing device which receives copy sheets bearing an image formed thereon and processes them, said sheet processing device includes a first sheet processor which executes a first process on the copy sheets and a second sheet processor which executes a second sheet process on the copy sheets, a maximum number of copy sheets on which said sheet processor is capable of executing both said first process and said second process is N; and a controller which controls said sheet processing device such that said sheet processor executes both said first process and said second process on the image-bearing copy sheets when the number of copy sheets is equal to or not larger than N and that said sheet processor executes said first process on the image-bearing copy sheet without executing said second process when the number of copy sheets is larger than N.

12. The image forming apparatus as claimed in claim 11, wherein said first processor includes a punch which punches the copy sheets.

13. The image forming apparatus as claimed in claim 11, wherein said second processor includes a binder which binds the copy sheets.

14. The image forming apparatus as claimed in claim 11, further comprising:

a sheet detector which detects copy sheets fed from said image forming device to said sheet processing device; and a counter which counts the number of the copy sheets fed to the sheet processing device in response to the sheet detector.

15. An image forming apparatus comprising:

a numerical input device which inputs a numerical value N which represents the number of desired copy sets;

a mode setting device which sets the operation modes of the image forming apparatus;

a copy start switch which inputs a command for initiating an operation of the image forming apparatus;

an image forming device which receives each of said copy sets and finishes them;

a controller which starts an operation of said image forming device under the set operation mode in response to the command and operates said sheet finishing device to finish a first set of copy sheets formed by said image forming device, said controller temporarily stopping the operation of said image forming device and said finishing device when said finishing device has finished the first set of copy sheets, said controller resuming the operation of the image forming apparatus in order to make the (N−1) sets of copy sheets without changing the copy mode when no mode change has occurred after stopping the operation of said image forming device and said finishing device, said controller resuming the operation of the image forming apparatus in order to make N sets of copy sheets under a new operation mode when the new operation mode is set after stopping the operation of said image forming device and said finishing device.

16. The copying apparatus as claimed in claim 15, wherein said sheet finishing device includes a stapler which staples each of said copy sets produced by said image forming device.

17. The copying apparatus as claimed in claim 15, wherein said sheet finishing device includes a punch which punches each of said copy sets produced by said image forming device.

18. The copying apparatus as claimed in claim 15, wherein said image forming device includes:

an automatic document feeder which supports a set of originals on a support tray and feeds the originals one by one to an exposure platen and returns the originals from the exposure platen to the support tray.

* * * * *